US008692860B2

(12) United States Patent
Inoue

(10) Patent No.: US 8,692,860 B2
(45) Date of Patent: Apr. 8, 2014

(54) LIGHT EMITTING DEVICE, PRINT HEAD, AND IMAGE FORMING APPARATUS

(75) Inventor: Michihiro Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 26 days.

(21) Appl. No.: 13/292,288

(22) Filed: Nov. 9, 2011

(65) Prior Publication Data

US 2012/0256998 A1 Oct. 11, 2012

(30) Foreign Application Priority Data

Apr. 7, 2011 (JP) ..... 2011-085825

(51) Int. Cl.

| | |
|---|---|
| ***B41J 2/385*** | (2006.01) |
| ***B41J 2/47*** | (2006.01) |
| ***B41J 2/45*** | (2006.01) |
| ***B41J 2/435*** | (2006.01) |

(52) U.S. Cl.

USPC ..... 347/247; 347/130; 347/237; 347/238

(58) Field of Classification Search

None

See application file for complete search history.

(56) References Cited

U.S. PATENT DOCUMENTS

| | | | | |
|---|---|---|---|---|
| 6,008,833 | A * | 12/1999 | Ohtsubo et al. | 347/237 |
| 7,954,917 | B2 | 6/2011 | Inoue | |
| 2003/0058329 | A1 | 3/2003 | Ohno | |
| 2008/0079461 | A1* | 4/2008 | Lin et al. | 326/80 |
| 2010/0117557 | A1 | 5/2010 | Ohno | |
| 2010/0214626 | A1* | 8/2010 | Tsuchiya et al. | 358/461 |
| 2011/0044708 | A1* | 2/2011 | Kusakabe | 399/49 |

FOREIGN PATENT DOCUMENTS

| | | | |
|---|---|---|---|
| JP | 2001-094155 | A | 4/2001 |
| JP | 2004-122584 | A | 4/2004 |
| JP | 2007-307724 | A | 11/2007 |
| JP | 2008-087291 | A | 4/2008 |

OTHER PUBLICATIONS

Office Action issued in corresponding Australian Patent Application No. 2011254015, dated Oct. 3, 2012.

* cited by examiner

*Primary Examiner* — Matthew Luu
*Assistant Examiner* — Kendrick Liu
(74) *Attorney, Agent, or Firm* — Sughrue Mion, PLLC

(57) ABSTRACT

A light emitting device includes light emitting chips, a mount board on which the light emitting chips are mounted, and a buffer amplifier. Each of the light emitting chips includes light emitting elements and transfer elements. The transfer element sequentially specify, by sequentially entering an on-state, the light emitting elements as targets for control of illumination or non-illumination. Each of the transfer elements is provided for a corresponding one of the light emitting elements. The buffer amplifier is provided on the mount board, and outputs a transfer signal on the basis of an input transfer signal. The transfer signal is used to sequentially set the transfer elements, which are included in each of the light emitting chips, to be in the on-state.

13 Claims, 15 Drawing Sheets

| PIN NUMBER | SIGNAL NAME | |
|---|---|---|
| 1 | SCK | Ia |
| 2 | SDA | |
| 3 | WC | |
| 4 | Vga | IIa |
| 5 | φ1 | |
| 6 | Vsub | IIIa |
| 7 | φI1 | |
| 8 | φI2 | |
| 9 | Vsub | |
| 10 | φI3 | |
| 11 | φI4 | |
| 12 | Vsub | |
| 13 | φI5 | |
| 14 | φI6 | |
| 15 | Vsub | |
| 16 | φI7 | |
| 17 | φI8 | |
| 18 | Vsub | |
| 19 | φI9 | |
| 20 | φI10 | |
| 21 | Vsub | |
| 22 | φI11 | |
| 23 | φI12 | |
| 24 | Vsub | |
| 25 | φI13 | |
| 26 | φI14 | |
| 27 | Vsub | |
| 28 | φI15 | |
| 29 | φI16 | |
| 30 | Vsub | |
| 31 | φI17 | |
| 32 | φI18 | |
| 33 | Vsub | |
| 34 | φI19 | |
| 35 | φI20 | |
| 36 | Vsub | |
| 37 | Vga | IVa |
| 38 | Vga | |
| 39 | φ2 | |
| 40 | Vga | |

| PIN NUMBER | SIGNAL NAME | |
|---|---|---|
| 1 | SCK | Ia |
| 2 | SDA | |
| 3 | WC | |
| 4 | Vga | IIa |
| 5 | $\phi$1 | |
| 6 | Vsub | IIIa |
| 7 | $\phi$I1 | |
| 8 | Vsub | |
| 9 | $\phi$I2 | |
| 10 | Vsub | |
| 11 | $\phi$I3 | |
| 12 | Vsub | |
| 13 | $\phi$I4 | |
| 14 | Vsub | |
| 15 | $\phi$I5 | |
| 16 | Vsub | |
| 17 | $\phi$I6 | |
| 18 | Vsub | |
| 19 | $\phi$I7 | |
| 20 | Vsub | |
| 21 | $\phi$I8 | |
| 22 | Vsub | |
| 23 | $\phi$I9 | |
| 24 | Vsub | |
| 25 | $\phi$I10 | |
| 26 | Vsub | |
| 27 | $\phi$I11 | |
| 28 | Vsub | |
| 29 | $\phi$I12 | |
| 30 | Vsub | |
| 31 | $\phi$I13 | |
| 32 | Vsub | |
| 33 | $\phi$I14 | |
| 34 | Vsub | |
| 35 | $\phi$I15 | |
| 36 | Vsub | |
| 37 | $\phi$I16 | |
| 38 | Vsub | |
| 39 | $\phi$I17 | |
| 40 | Vsub | |
| 41 | $\phi$I18 | |
| 42 | Vsub | |
| 43 | $\phi$I19 | |
| 44 | Vsub | |
| 45 | $\phi$I20 | |
| 46 | Vsub | |
| 47 | Vga | IVa |
| 48 | Vga | |
| 49 | $\phi$2 | |
| 50 | Vga | |

| PIN NUMBER | SIGNAL NAME | |
|---|---|---|
| 1 | SCK | Ib |
| 2 | SDA | |
| 3 | WC | |
| 4 | $\phi$1-3 | IIb |
| 5 | $\phi$1-1 | |
| 6 | Vga | |
| 7 | $\phi$1-2 | |
| 8 | $\phi$1-4 | |
| 9 | Vsub | IIIb |
| 10 | $\phi$I1 | |
| 11 | $\phi$I2 | |
| 12 | $\phi$I3 | |
| 13 | $\phi$I4 | |
| 14 | Vsub | |
| 15 | $\phi$I5 | |
| 16 | $\phi$I6 | |
| 17 | $\phi$I7 | |
| 18 | $\phi$I8 | |
| 19 | Vsub | |
| 20 | $\phi$I9 | |
| 21 | $\phi$I10 | |
| 22 | $\phi$I11 | |
| 23 | $\phi$I12 | |
| 24 | Vsub | |
| 25 | $\phi$I13 | |
| 26 | $\phi$I14 | |
| 27 | $\phi$I15 | |
| 28 | $\phi$I16 | |
| 29 | Vsub | |
| 30 | $\phi$I17 | |
| 31 | $\phi$I18 | |
| 32 | $\phi$I19 | |
| 33 | $\phi$I20 | |
| 34 | Vsub | |
| 35 | $\phi$2-4 | IVb |
| 36 | $\phi$2-2 | |
| 37 | Vga | |
| 38 | $\phi$2-3 | |
| 39 | $\phi$2-1 | |
| 40 | Vga | |

LIGHT EMITTING DEVICE, PRINT HEAD, AND IMAGE FORMING APPARATUS

CROSS-REFERENCE TO RELATED APPLICATIONS

This application is based on and claims priority under 35 USC 119 from Japanese Patent Application No. 2011-085825 filed Apr. 7, 2011.

BACKGROUND (i) Technical Field

The present invention relates to a light emitting device, a print head, and an image forming apparatus.

(ii) Related Art

In image forming apparatuses employing an electrophotographic system, such as printers, copiers, or facsimile machines, image formation is performed as follows: irradiation using image information is performed by an optical recording unit, thereby obtaining an electrostatic latent image on a charged photoconductor; visualization is performed by applying toner onto the electrostatic latent image to obtain an image; and the image is transferred onto a sheet of recording paper, and is fixed. An optical scanning method is employed, in which a laser is used as such an optical recording unit, and in which exposure to light is performed by scanning using laser light in the main scanning direction. In addition to the optical scanning method, in recent years, a light emitting device using a light emitting diode (LED) print head (LPH) is employed in response to a demand for miniaturization of devices. In the LPH, multiple LEDs serving as light emitting elements are disposed along the main scanning direction.

SUMMARY

According to an aspect of the invention, there is provided a light emitting device including multiple light emitting chips, a mount board, and a buffer amplifier. Each of the multiple light emitting chips includes multiple light emitting elements and multiple transfer elements. The multiple transfer elements sequentially specify, by sequentially entering an on-state, the multiple light emitting elements as targets for control of illumination or non-illumination. Each of the multiple transfer elements is provided for a corresponding one of the multiple light emitting elements. On the mount board, the multiple light emitting chips are mounted. The buffer amplifier is provided on the mount board, and outputs a transfer signal on the basis of an input transfer signal. The transfer signal is used to sequentially set the multiple transfer elements, which are included in each of the multiple light emitting chips, to be in the on-state.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail with reference to the accompanying drawings.

First Exemplary Embodiment

Image Forming Apparatus 1

Figure 1:
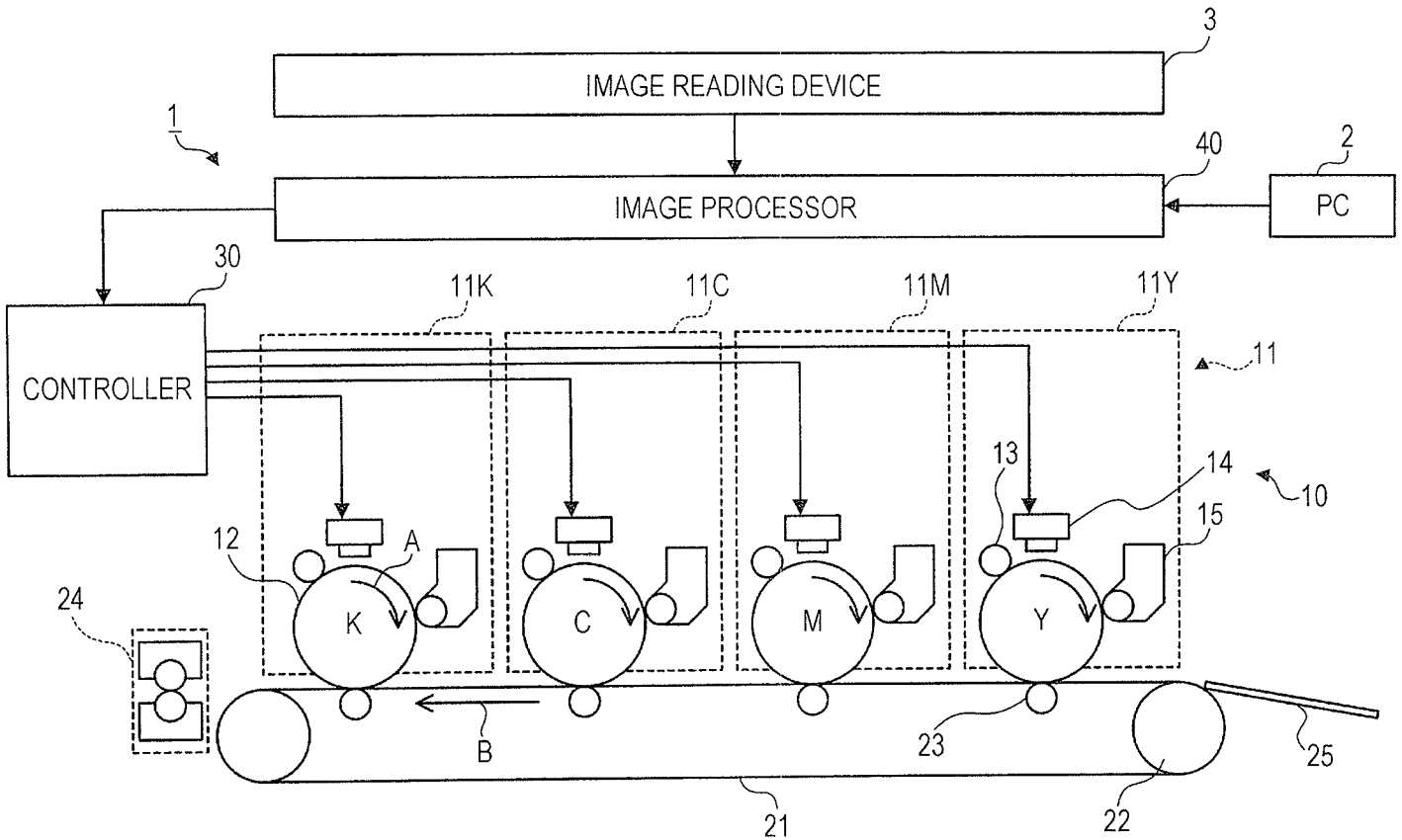
FIG. 1 is a diagram illustrating an example of an overall configuration of an image forming apparatus according to a first exemplary embodiment.

FIG. 1 is a diagram illustrating an example of an overall configuration of an image forming apparatus 1 according to a first exemplary embodiment. The image forming apparatus 1 illustrated in FIG. 1 is an image forming apparatus of a so-called tandem type. The image forming apparatus 1 includes an image-forming-process section 10, a controller 30, and an image processor 40. The image-forming-process section 10 performs image formation in accordance with an image data item for each of colors. The controller 30 controls the image-forming-process section 10. The image processor 40 is connected to, for example, a personal computer (PC) 2 and an image reading device 3, and performs predetermined image processing on an image data item that has been received from the PC 2 or the image reading device 3.

The image-forming-process section 10 includes an image forming unit 11 that includes multiple engines which are disposed in parallel at predetermined intervals. The image forming unit 11 includes four image forming units 11Y, 11M, 11C, and 11K. Each of the image forming units 11Y, 11M, 11C, and 11K includes a photoconductor drum 12, a charger 13, a print head 14, and a developing device 15. The photoconductor drum 12 serves as an example of an image carrier on which an electrostatic latent image is formed and which holds a toner image. The charger 13 serves as an example of a charging section that charges, using a predetermined potential, the surface of the photoconductor drum 12. The print head 14 exposes, to light, the photoconductor drum 12 that has been changed by the charger 13. The developing device 15 serves as an example of a developing section that develops the electrostatic latent image which has been obtained using the print head 14. The image forming units 11Y, 11M, 11C, and 11K form toner images of yellow (Y), magenta (M), cyan (C), and black (K), respectively.

Furthermore, in order to transfer the toner images of the individual colors, which have been formed on the photoconductor drums 12 of the individual image forming units 11Y, 11M, 11C, and 11K, onto a sheet of recording paper 25, which serves as an example of a transfer-receiving body, using multiple transfers, the image-forming-process section 10 includes a sheet transport belt 21, a driving roller 22, a transfer roller 23, and a fixing device 24. The sheet transport belt 21 transports the sheet of recording paper 25. The driving roller 22 is a roller that drives the sheet transport belt 21. The transfer roller 23 serves as an example of a transferring section that transfers the toner images, which are formed on the photoconductor drums 12, onto the sheet of recording paper 25. The fixing device 24 fixes the toner images on the sheet of recording paper 25.

In the image forming apparatus 1, the image-forming-process section 10 performs an image formation operation in accordance with various types of control signals that are supplied from the controller 30. The image data item that has been received from the PC 2 or the image reading device 3 is subjected to image processing by the image processor 40, and supplied to the image forming unit 11 by the controller 30. Then, for example, in the image forming unit 11K for black (K), the photoconductor drum 12 is charged by the charger 13 so as to have the predetermined potential while rotating in the direction indicated by the arrow A. The photoconductor drum 12 is exposed to light by the print head 14 that emits the light on the basis of the image data item which has been processed by the image processor 40. Accordingly, on the photoconductor drum 12, an electrostatic latent image associated with an image of black (K) is formed. Then, the electrostatic latent image, which has been formed on the photoconductor drum 12, is developed by the developing device 15, thereby forming a toner image of black (K) on the photoconductor drum 12. Also in each of the image forming units 11Y, 11M, and 11C, a corresponding one of toner images of the individual colors that are yellow (Y), magenta (M), and cyan (C) is formed.

The sheet of recording paper 25 is supplied in accordance with movement of the sheet transport belt 21 that moves in the direction indicated by the arrow B. The toner images of the individual colors, which have been formed on the photoconductor drums 12 in the image forming units 11, are sequentially electrostatically transferred, onto the sheet of recording paper 25, using a transfer electric field that is applied to the transfer roller 23, whereby a combined toner image in which the toner images of the individual colors are superimposed on each other is formed on the sheet of recording paper 25.

After that, the sheet of recording paper 25, onto which the combined toner image has been electrostatically transferred, is transported to the fixing device 24. The combined toner image on the sheet of recording paper 25, which has been transported to the fixing device 24, is subjected to a fixing process so as to be fixed by heating and by applying a pressure, thereby fixing the combined toner image on the sheet of recording paper 25, and is ejected from the image forming apparatus 1.

(Print Head 14)

Figure 2:
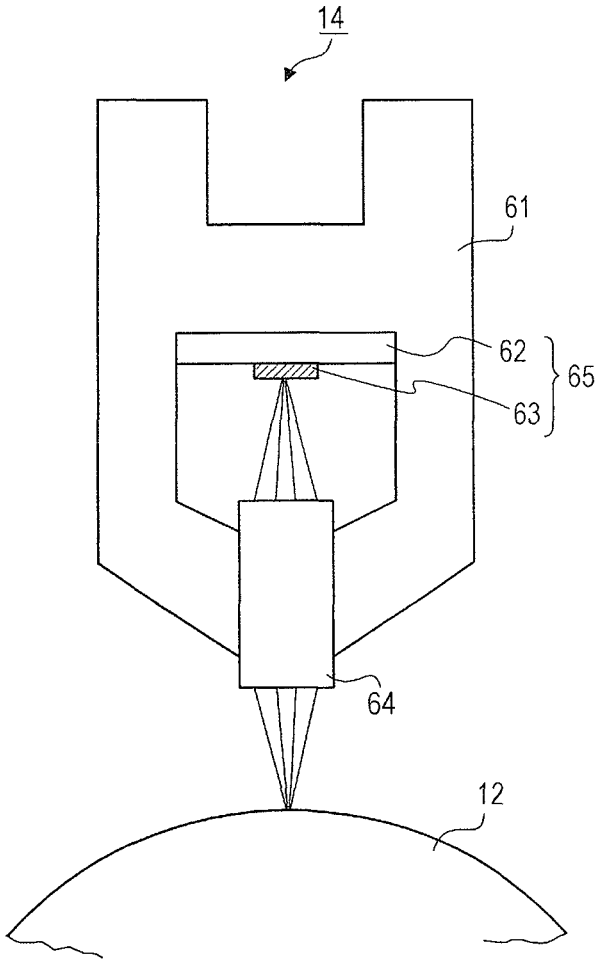
FIG. 2 is a cross-sectional view of a print head, which illustrates a configuration of the print head.

FIG. 2 is a cross-sectional view of the print head 14, which illustrates a configuration of the print head 14. The print head 14 includes a housing 61, a light emitting device 65, and a rod-lens array 64. The light emitting device 65 serves as an example of a light emitting section that includes a light source unit 63 which includes multiple light emitting elements that expose the photoconductor drum 12 to light. The rod-lens array 64 serves as an example of an optical section that forms, using light that is output from the light source unit 63, an image on the surface of the photoconductor drum 12.

The light emitting device 65 is configured so that the light source unit 63, which is mentioned above, and so forth are mounted on a light-emitting-chip mount board 62. The detailed configuration of the light emitting device 65 will be described below.

The housing 61 is formed of, for example, a metallic material, and supports the light-emitting-chip mount board 62 and the rod-lens array 64. The housing 61 is set so that light emission points of the light emitting elements of the light source unit 63 are in a focal plane of the rod-lens array 64. Furthermore, the rod-lens array 64 is disposed along the axial direction (which is the main scanning direction and which is the X direction illustrated in FIG. 3A and FIG. 4 described below) of the photoconductor drum 12.

(Controller 30 and Light Emitting Device 65)

Figures 3A, 3B:
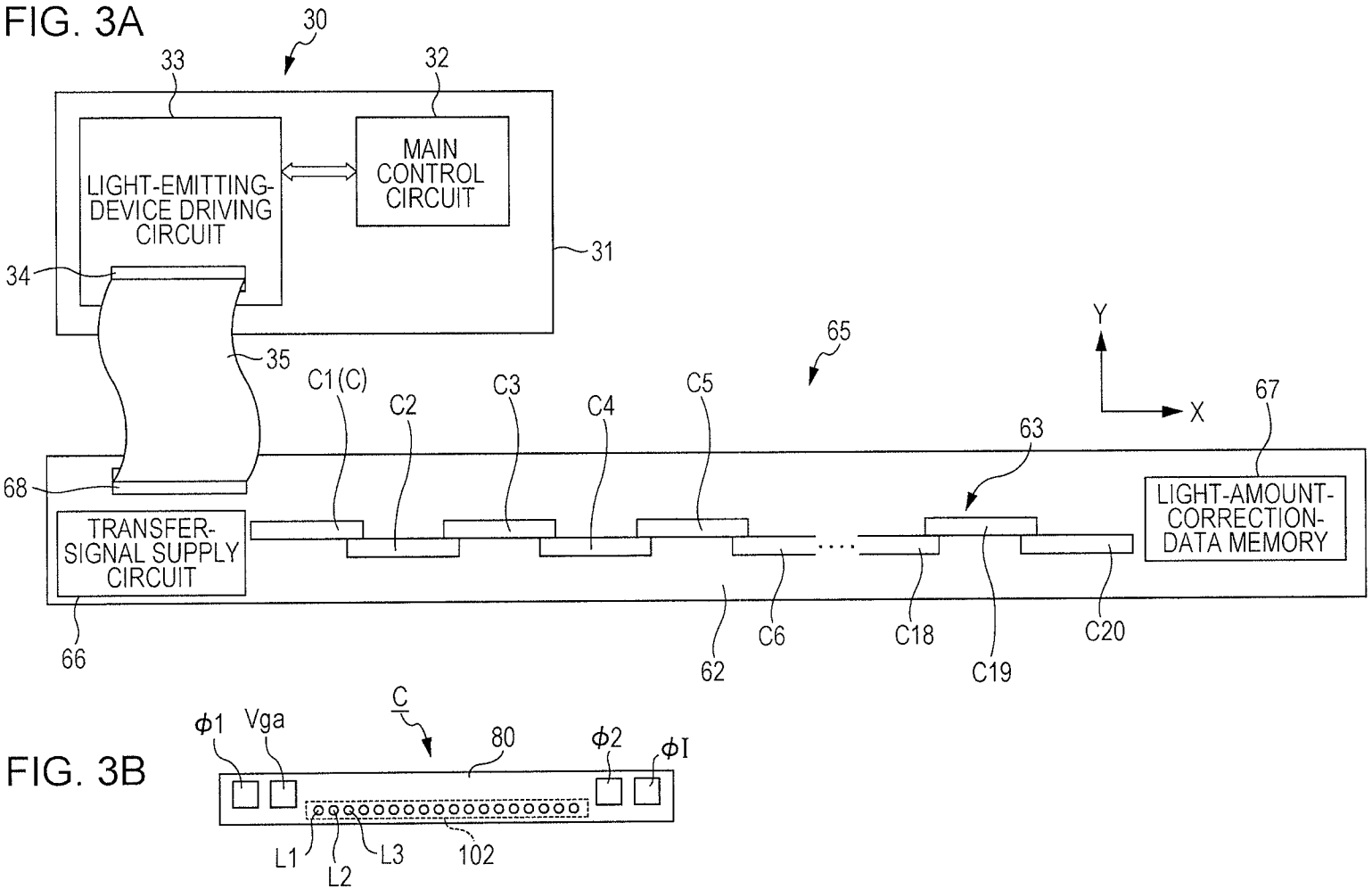
FIGS. 3A and 3B are a diagram that illustrates configurations of a controller and a light emitting device and the connection relationships therebetween, and a diagram that illustrates a configuration of light emitting chips in the first exemplary embodiment.

FIGS. 3A and 3B are a diagram illustrating configurations of the controller 30 and the light emitting device 65 and the connection relationships therebetween in the present exemplary embodiment, and a diagram that illustrates a configuration of light emitting chips C. FIG. 3A illustrates configurations of the controller 30 and the light emitting device 65, and the connection relationships therebetween. FIG. 3B illustrates a configuration of the light emitting chips C.

First, the configurations of the controller 30 and the light emitting device 65 and the connection relationships therebetween, which are illustrated in FIG. 3A, will be described.

As illustrated in FIG. 3A, the controller 30 is configured so that a main control circuit 32 and a light-emitting-device driving circuit 33 are mounted on a control board 31, and the light-emitting-device driving circuit 33 serves as an example of a driving unit that drives the light emitting device 65. The main control circuit 32 controls the chargers 13, the developing devices 15, the transfer roller 23, the fixing device 24, and so forth except the light emitting device 65. In other words, the main control circuit 32 performs control that is not performed by the light-emitting-device driving circuit 33 out of control performed for the image forming apparatus 1.

In contrast, the light-emitting-device driving circuit 33 transmits and receives, to/from the light emitting device 65, signals for performing control of illumination or non-illumination (illumination control) of the light emitting elements of the light source unit 63 of the light emitting device 65, thereby controlling the light emitting device 65.

The light-emitting-device driving circuit 33 includes a connector (a connection member) 34 that a cable 35 is connected to. The cable 35 is used to connect the light-emitting-device driving circuit 33 to the light emitting device 65, and is constituted by, for example, a multicore flexible flat cable (FFC).

Note that, although it is described that the controller 30 is mounted on the control board 31, the control board 31 may include multiple boards.

As illustrated in FIG. 3A, the light emitting device 65 is configured so that the light source unit 63 is disposed along the X direction, which is the main scanning direction, on the light-emitting-chip mount board 62 that serves as an example of a mount board. The light source unit 63 is configured so that twenty light emitting chips C1 to C20, each of which includes multiple light emitting elements, are disposed in a staggered pattern in two rows.

In the present specification, the term "to" refers to multiple components that are distinguished from one another by being numbered, and indicates that components which are described before and after the term "to" and which are numbered with certain numbers and components which are numbered with numbers that are between the certain numbers are included. For example, the light emitting chips C1 to C20 include light emitting chips starting with the light emitting chip C1 ending with the light emitting chip C20 in numerical order.

The configurations of the light emitting chips C1 to C20 may be the same. Thus, when the light emitting chips C1 to C20 are not distinguished from one another, the light emitting chips C1 to C20 are referred to as "light emitting chips C". The details of arrangement of the light emitting chips C1 to C20 will be described below.

Note that, although twenty in total is used as the number of light emitting chips C in the present exemplary embodiment, the number of light emitting chips C is not limited thereto.

The light emitting device 65 includes a transfer-signal supply circuit 66 that supplies signals (transfer signals) for providing a specification in order to causing the light emitting elements of the individual light emitting chips C to sequentially perform illumination. Moreover, the light emitting device 65 includes a light-amount-correction-data memory 67 that serves as an example of a storage member which stores control data items including data items (correction data items) for correcting amounts of light of the light emitting elements of the light emitting chips C, and which is constituted by a non-volatile memory such as an electrically erasable programmable read-only memory (EEPROM). The light emitting device 65 includes a connector 68 that serves as an example of a connection member for transmitting and receiving signals to/from the light-emitting-device driving circuit 33 of the controller 30.

As illustrated in FIG. 2, the light emitting device 65 is provided along the axial direction (the X direction) of the photoconductor drum 12. Accordingly, the light-emitting-chip mount board 62 is a member that is long in the X direction, and that has a small width in the Y direction. Accordingly, the transfer-signal supply circuit 66, the light-amount-correction-data memory 67, and the connector 68 are separately provided at the ends of the light-emitting-chip mount board 62 which is long.

Note that, although the transfer-signal supply circuit 66, the light-amount-correction-data memory 67, and the connector 68 are illustrated in FIG. 3A so as to be arranged on a side (a front side) of the light-emitting-chip mount board 62 on which the light emitting chips C are provided, all of or some of the transfer-signal supply circuit 66, the light-amount-correction-data memory 67, and the connector 68 may be provided on a side (a rear side) of the light-emitting-chip mount board 62 that is opposite to the side on which the light emitting chips C are provided.

Next, the configuration of the light emitting chips C illustrated in FIG. 3B will be described.

Each of the light emitting chips C includes a light emitting section 102 that includes multiple light emitting elements (light emitting thyristors L1, L2, L3, . . . which serve as examples of light emitting elements in the present exemplary embodiment) which are provided in a row along one longitudinal side of a rectangular board 80 on the surface of the board 80. Furthermore, the light emitting chip C includes terminals (a ϕ1 terminal, a ϕ2 terminal, a Vga terminal, and a ϕI terminal) that are multiple bonding pads for receiving various types of control signals and so forth, and the terminals are provided at the ends of the surface of the board 80 along the direction of the longitudinal side of the board 80. Note that, regarding the terminals, the ϕ1 terminal and the Vga terminal are provided in this order from one of the ends of the board 80, and the ϕI terminal and the ϕ2 terminal are provided in this order from the other end of the board 80. The light emitting section 102 is provided between the Vga terminal and the ϕ2 terminal. Furthermore, a rear-surface electrode is provided as a Vsub terminal on the rear surface of the board 80.

Note that, when the light emitting thyristors L1, L2, L3, . . . are not distinguished from one another, the light emitting thyristors L1, L2, L3, . . . are referred to as "light emitting thyristors L".

Note that the term "in a row" may be referred to not only a state in which the multiple light emitting elements are disposed in a straight line as illustrated in FIG. 3B, but also a state in which the individual light emitting elements are disposed along a direction orthogonal to the direction of the row so as to have displacement amounts that are different from one another. For example, when light emitting regions of the light emitting elements are considered as pixels, each of the light emitting elements may be disposed so as to have a displacement amount corresponding to a few pixels or a few tens of pixels along the direction orthogonal to the direction of the row. Furthermore, the light emitting elements may be disposed in a zigzag pattern so that the light emitting elements adjacent to each other are placed in an alternating manner or may be disposed in a zigzag pattern in units of multiple light emitting elements.

Figure 4:
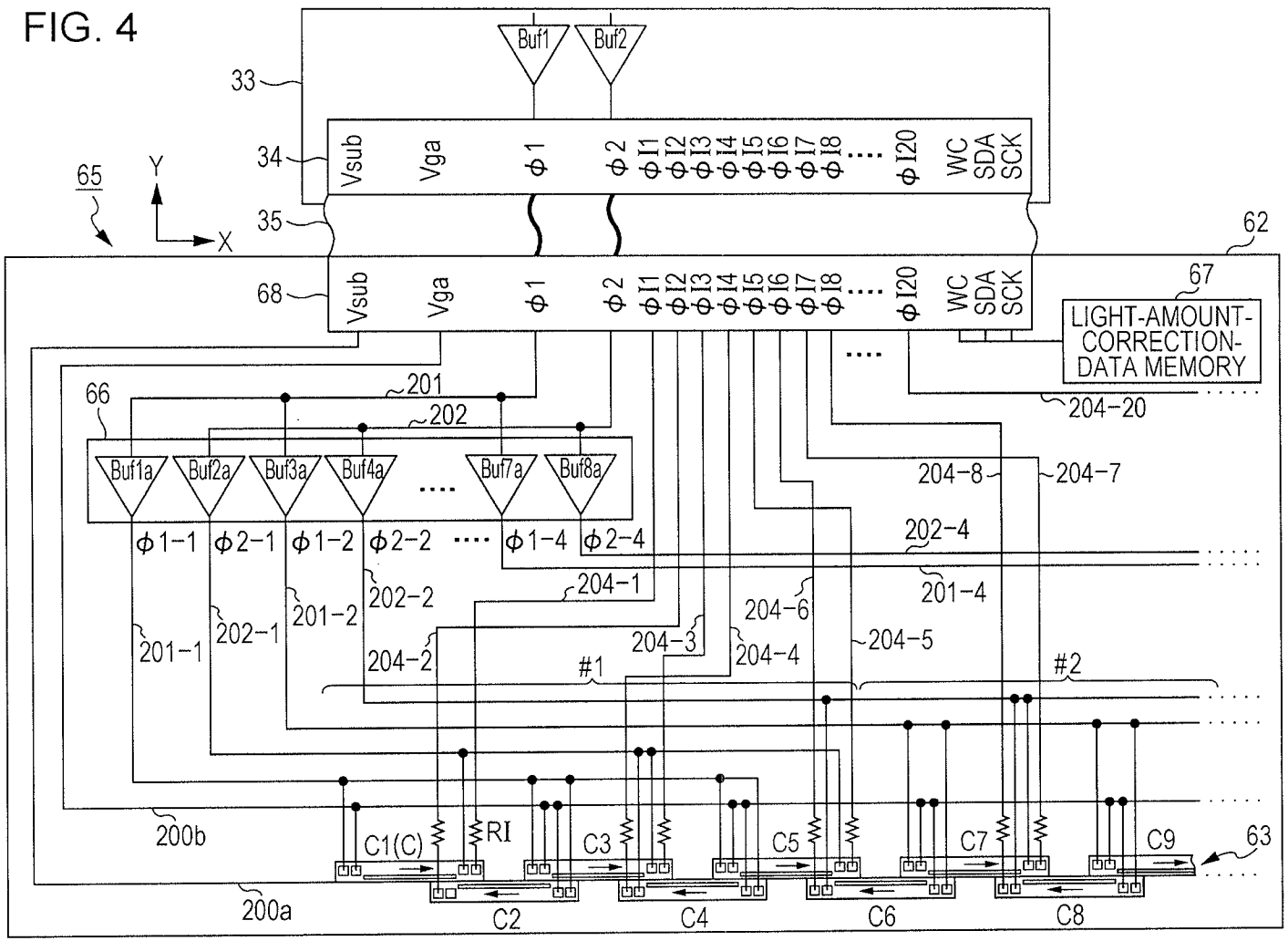
FIG. 4 is a diagram illustrating a configuration of wiring patterns (lines) on a light-emitting-chip mount board of the light emitting device according to the first exemplary embodiment.

FIG. 4 is a diagram illustrating a configuration of wiring patterns (lines) on the light-emitting-chip mount board 62 of the light emitting device 65 according to the first exemplary embodiment. Note that, in FIG. 4, one portion of the light-emitting-device driving circuit 33, the connector 34, and the cable 35 are illustrated together with the wiring patterns.

As described above, on the light-emitting-chip mount board 62 of the light emitting device 65, the light emitting chips C1 to C20, the transfer-signal supply circuit 66, the light-amount-correction-data memory 67, and the connector 68 are mounted, and wiring patterns (lines) that connect the light emitting chips C1 to C20, the transfer-signal supply circuit 66, the light-amount-correction-data memory 67, and the connector 68 with each other are provided.

First, the connector 68 will be described. Here, for convenience of description, the connector 68 is illustrated on the top portion of the light-emitting-chip mount board 62, which is different from FIG. 3A. In the connector 68 illustrated in FIG. 4, signals that are transmitted or received to/from the light-emitting-device driving circuit 33 illustrated in FIG. 3A are represented by the names thereof.

The connector 68 is connected by the cable 35 to the connector 34 that is provided in the light-emitting-device driving circuit 33 and that has a configuration which is the same as the configuration of the connector 68.

Note that the arrangement of terminals (PINs) of the connector 68 (the same is true for the connector 34) is described below.

A first transfer signal ϕ1 and a second transfer signal ϕ2 that are transmitted to the transfer-signal supply circuit 66, and illumination signals ϕI1 to ϕI20 that are individually transmitted to the respective light emitting chips C1 to C20 are provided as signals transmitted from the light-emitting-device driving circuit 33 to the light emitting device 65. Note that, when the first transfer signal ϕ1 and the second transfer signal ϕ2 are not distinguished from each other, the first transfer signal ϕ1 and the second transfer signal ϕ2 are referred to as "transfer signals", and, when the illumination signals ϕI1 to ϕI20 are not distinguished from one another, the illumination signals ϕI1 to ϕI20 are referred to as "illumination signals ϕI".

Moreover, a series of signals (an SCK signal, an SDA signal, and a WC signal) that are used to transmit and receive light-amount correction data items between the light-amount-correction-data memory 67 of the light emitting device 65 and the light-emitting-device driving circuit 33 is provided as signals transmitted/received between the light-emitting-device driving circuit 33 and the light emitting device 65. The series of signals is described below.

In addition to the above-mentioned signals, a potential Vga and a reference potential Vsub are supplied from the light-emitting-device driving circuit 33 to the light emitting device 65. Note that the potential Vga and the reference potential Vsub are treated as signals.

Note that portions associated with the first transfer signal ϕ1 and the second transfer signal ϕ2 are extracted and shown in the light-emitting-device driving circuit 33 and the cable 35 which are illustrated in FIG. 4.

Next, the arrangement of the light emitting chips C1 to C20 will be described.

The odd-numbered light emitting chips C1, C3, C5, . . . are disposed in a row at intervals along the direction of the longitudinal sides of the boards 80 of the individual light emitting chips C1, C3, C5, . . . . Similarly, the even-numbered light emitting chips C2, C4, C6, . . . are also disposed in a row at intervals along the direction of the longitudinal sides of the boards 80 of the individual light emitting chips C2, C4, C6, . . . . The light emitting chips C1, C3, C5, . . . and the light emitting chips C2, C4, C6, . . . are disposed in a staggered pattern in a state in which each of the light emitting chips C is rotated by 180 degrees with respect to the light emitting chips C adjacent to the light emitting chip so that the longitudinal sides on the light emitting section 102 side oppose each other, the light emitting sections 102 being provided in the light emitting chips C. The positions of the individual light emitting chips C are set so that even the light emitting elements of the light emitting chips C adjacent to each other are arranged at predetermined intervals along the main scanning direction. Note that the direction of arrangement of the light emitting elements (the numerical order of the light emitting thyristors L1, L2, L3, . . . in the present exemplary embodiment) of the light emitting section 102 illustrated in FIG. 3B is indicated by each arrow in a corresponding one of the light emitting chips C1, C2, C3, . . . illustrated in FIG. 4.

The twenty light emitting chips C1 to C20 are grouped into groups (light-emitting-chip groups #1 to #4), and each of the groups is constituted by five light emitting chips C. In other words, the light emitting chips C1 to C5 constitute the light-emitting-chip group #1, and the light emitting chips C6 to C10 constitute the light-emitting-chip group #2. Similarly, the other light-emitting-chip groups #3 and #4 are also constituted by the corresponding light emitting chips C. FIG. 4 illustrates portions of the light-emitting-chip group #1 (the light emitting chips C1 to C5) and the light-emitting-chip group #2 (the light emitting chips C6 to C9).

A configuration of the transfer-signal supply circuit 66 will be described.

The transfer-signal supply circuit 66 includes buffer circuits Buf1*a* to Buf8*a* that serve as examples of eight buffer amplifiers. The buffer circuits Buf1*a* to Buf8*a* are configured as one integrated circuit (IC) that is formed of, for example, complementary metal-oxide semiconductor (CMOS).

Additionally, each of the buffer circuits Buf1*a* to Buf8*a* may include an enable terminal (OE). In the present exemplary embodiment, it is supposed that an enable signal is always supplied to the enable terminal (OE).

Next, signals that are transmitted and received using the connector 68, and wiring patterns (lines) that connect the connector 68, the light emitting chips C1 to C20, and the transfer-signal supply circuit 66 to each other will be described.

A potential line 200*a* is provided on the light-emitting-chip mount board 62, and is connected from Vsub terminals (PINs) of the connector 68 to the rear-surface electrodes (the Vsub terminals) that are provided on the rear surfaces of the boards 80 of the light emitting chips C. The reference potential Vsub that is used as the reference for potential is supplied to the potential line 200*a*. A potential line 200*b* is provided on the light-emitting-chip mount board 62, and is connected from Vga terminals (PINs) of the connector 68 to the Vga terminals that are provided in the individual light emitting chips C. The potential Vga for driving the light emitting chips C is supplied to the potential line 200*b*.

A first-transfer-signal line 201 is provided on the light-emitting-chip mount board 62. The first-transfer-signal line 201 is connected as a common signal line from a ϕ1 terminal (PIN) of the connector 68 to input terminals of the individual odd-numbered buffer circuit Buf1*a*, Buf3*a*, Buf5*a*, and Buf7*a* of the transfer-signal supply circuit 66. The first transfer signal ϕ1 is transmitted through the first-transfer-signal line 201 to the transfer-signal supply circuit 66.

Furthermore, a second-transfer-signal line 202 is provided on the light-emitting-chip mount board 62. The second-transfer-signal line 202 is connected as a common signal line from a ϕ2 terminal (PIN) of the connector 68 to input terminals of the individual even-numbered buffer circuit Buf2*a*, Buf4*a*, Buf6*a*, and Buf8*a* of the transfer-signal supply circuit 66. The second transfer signal ϕ2 is transmitted through the second-transfer-signal line 202 to the transfer-signal supply circuit 66.

Additionally, a first-transfer-signal line 201-1 is provided on the light-emitting-chip mount board 62. The first-transfer-signal line 201-1 is connected from an output terminal of the buffer circuit Buf1*a* to the ϕ1 terminal of each of the light emitting chips C1 to C5 that belong to the light-emitting-chip group #1. The buffer circuit Buf1*a* outputs a first transfer signal ϕ1-1, and the first transfer signal ϕ1-1 is transmitted through the first-transfer-signal line 201-1 to the ϕ1 terminal of each of the light emitting chips C1 to C5 that belong to the light-emitting-chip group #1. Moreover, a second-transfer-signal line 202-1 is provided. The second-transfer-signal line 202-1 is connected from an output terminal of the buffer circuit Buf2*a* to the ϕ2 terminal of each of the light emitting chips C1 to C5 that belong to the light-emitting-chip group #1. The buffer circuit Buf2*a* outputs a second transfer signal ϕ2-1, and the second transfer signal ϕ2-1 is transmitted through the second-transfer-signal line 202-1 to the ϕ2 terminal of each of the light emitting chips C1 to C5 that belong to the light-emitting-chip group #1.

Similarly, a first-transfer-signal line 201-2 is provided. The first-transfer-signal line 201-2 is connected from an output terminal of the buffer circuit Buf3*a* to the ϕ1 terminal of each of the light emitting chips C6 to C10 that belong to the light-emitting-chip group #2. The buffer circuit Buf3*a* outputs a first transfer signal ϕ1-2, and the first transfer signal ϕ1-2 is transmitted through the first-transfer-signal line 201-2 to the ϕ1 terminal of each of the light emitting chips C6 to C10 that belong to the light-emitting-chip group #2. Furthermore, a second-transfer-signal line 202-2 is provided. The second-transfer-signal line 202-2 is connected from an output terminal of the buffer circuit Buf4*a* to the ϕ2 terminal of each of the light emitting chips C6 to C10 that belong to the light-emitting-chip group #2. The buffer circuit Buf4*a* outputs a second transfer signal ϕ2-2, and the second transfer signal ϕ2-2 is transmitted through the second-transfer-signal line 202-2 to the ϕ2 terminal of each of the light emitting chips C6 to C10 that belong to the light-emitting-chip group #2.

The relationships between the buffer circuits Buf5*a* and Buf6*a* and the light-emitting-chip group #3 and the relationships between the buffer circuits Buf7*a* and Buf8*a* and the light-emitting-chip group #4 are also similar to the relationships described above.

Furthermore, illumination-signal lines 204-1 to 204-20 are provided. Each of the illumination-signal lines 204-1 to 204-20 is connected from the connector 68 to the ϕI terminal of a corresponding one of the light emitting chips C1 to C20. Each of the illumination signals ϕI1 to ϕI2 is transmitted through a corresponding one of the illumination-signal lines 204-1 to 204-20.

As described above, in the present exemplary embodiment, each of the first transfer signals ϕ1-1, ϕ1-2, ϕ1-3, and ϕ1-4 is transmitted via a corresponding one of the odd-numbered buffer circuit Buf1*a*, Buf3*a*, Buf5*a*, and Buf7*a* to the light emitting chips C that belong to a corresponding one of the light-emitting-chip groups #1 to #4. Each of the second transfer signals ϕ2-1, ϕ2-2, ϕ2-3, and ϕ2-4 is transmitted via a corresponding one of the even-numbered buffer circuit Buf2*a*, Buf4*a*, Buf6*a*, and Buf8*a* to the light emitting chips C that belong to a corresponding one of the light-emitting-chip groups #1 to #4.

The first transfer signal ϕ1 is transmitted from a buffer circuit Buf1, which is provided in the light-emitting-device driving circuit 33, to the input terminals of the odd-numbered buffer circuit Buf1*a*, Buf3*a*, Buf5*a*, and Buf7*a*. The second transfer signal ϕ2 is transmitted from a buffer circuit Buf2, which is provided in the light-emitting-device driving circuit 33, to the input terminals of the even-numbered buffer circuit Buf2*a*, Buf4*a*, Buf6*a*, and Buf8*a*.

Note that, when the first transfer signals ϕ1, ϕ1-1, ϕ1-2, ϕ1-3, and ϕ1-4 and the second transfer signals ϕ2, ϕ2-1, ϕ2-2, ϕ2-3, and ϕ2-4 are not distinguished from one another, the first transfer signals ϕ1, ϕ1-1, ϕ1-2, ϕ1-3, and ϕ1-4 and the second transfer signals ϕ2, ϕ2-1, ϕ2-2, ϕ2-3, and ϕ2-4 are referred to as "transfer signals".

The buffer circuits Buf1*a* to Buf8*a* transmit output signals having waveforms that are the same as the waveforms of input signals. In other words, the buffer circuits Buf1*a* to Buf8*a* are circuits that operate using potentials indicating logic levels ("H" and "L" which are described below). The buffer circuits Buf1*a* to Buf8*a* shape the waveforms of input signals to output signals. Even when the potentials at the input terminals thereof vary, the buffer circuits Buf1*a* to Buf8*a* can adjust the potentials so that the potentials are made to be the potentials indicating the logic levels. Furthermore, the buffer circuits Buf1*a* to Buf8*a* can individually supply currents from the respective output terminals thereof.

Thus, each of the waveforms of the first transfer signals ϕ1-1, ϕ1-2, ϕ1-3, and ϕ1-4 is the same as that of the first transfer signal ϕ1. Similarly, each of the waveforms of the second transfer signals ϕ2-1, ϕ2-2, ϕ2-3, and ϕ2-4 is the same as that of the second transfer signal ϕ2.

In other words, the signals having a waveform that is the same as the waveform of the first transfer signal ϕ1, and the signals having a waveform that is the same as the waveform of the second transfer signal ϕ2 are transmitted as common signals to all of the light emitting chips C.

Accordingly, it is considered that each of the first transfer signal ϕ1 and the second transfer signal ϕ2 may be supplied via a common wiring pattern (a bus) without providing the buffer circuits Buf1*a* to Buf8*a*. However, the reason why the buffer circuits Buf1*a* to Buf8*a* are provided is that there is a limit of a current that a buffer circuit can supply. For example, a current that a buffer circuit formed of CMOS can supply is limited to 30 mA. For this reason, in the present exemplary embodiment, the twenty light emitting chips C are grouped into four groups, and two buffer circuits (for example, the buffer circuits Buf1*a* and Buf2*a* for the light-emitting-chip group #1) are provided for each of the groups.

Thus, the reference potential Vsub and the potential Vga are supplied as common signals to all of the light emitting chips C1 to C20 on the light-emitting-chip mount board 62. The signals (the first transfer signals ϕ1-1, ϕ1-2, ϕ1-3, and ϕ1-4) having a waveform that is the same as the waveform of the first transfer signal ϕ1, and the signals (the second transfer signals ϕ2-1, ϕ2-2, ϕ2-3, and ϕ2-4) having a waveform that is the same as the waveform of the second transfer signal ϕ2 are transmitted as common signals to the light emitting chips C1 to C20 (in parallel). In contrast, the illumination signals ϕI1 to ϕI20 are individually transmitted to the respective light emitting chips C1 to C20.

(Connector 34, Cable 35, and Connector 68)

Next, the arrangement (PIN arrangement) of the terminals (PINs) of the connector 34, which is provided in the light-emitting-device driving circuit 33, and the connector 68, which is provided on the light-emitting-chip mount board 62, will be described. Note that the arrangement of wiring patterns included in the cable 35 that connects between the connectors 34 and 68 is the same as the arrangement of the terminals of the connectors 34 and 68. Hereinafter, the arrangement of the terminals will be described as the PIN arrangement of the connector 68.

Figures 5A, 5B:
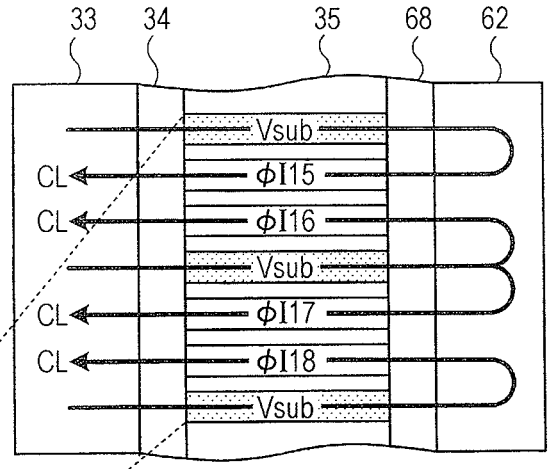
FIGS. 5A and 5B are diagrams illustrating an example of the PIN arrangement of a connector.

FIGS. 5A and 5B are diagrams illustrating an example of the PIN arrangement of the connector 68. FIG. 5A is a diagram of the PIN arrangement of the connector 68. FIG. 5B is a diagram in which the PIN arrangement of the PINs assigned to the illumination signals ϕI is illustrated so as to be enlarged. Note that, in FIG. 5B, in addition to the connector 68, the light-emitting-device driving circuit 33, the connector 34, and the light-emitting-chip mount board 62 are also illustrated.

The cable 35 is an FFC as described above. In an FFC, multiple wiring patterns are disposed in parallel at a predetermined pitch. Accordingly, the PINs of each of the connectors 68 and 34 are also disposed in a row.

Note that, although provision of a shielding layer on an FFC is considered in order to reduce noise, the configuration in the present exemplary embodiment can be provided at a lower cost.

As illustrated in FIG. 5A, the connector 68 includes, for example, forty terminals (PINs). The forty terminals (PINs) are grouped into four groups. In other words, the four groups are the following: a group Ia of the PINs #1 to #3 that are used to transmit and receive light-amount correction data items which serve as examples of correction values used to correct the amounts of light; a group IIa of the PINs #4 and #5 that are used to transmit the first transfer signal ϕ1; a group IIIa of the PINs #6 to #36 that are used to transmit the illumination signals ϕI1 to ϕI20; and a group IVa of the PINs #37 to #40 that are used to transmit the second transfer signal ϕ2. Terminals (PINs) that are used to supply the potential Vga and the reference potential Vsub are included.

Note that, regarding the group IIIa illustrated in FIG. 5A, although the PINs assigned to the illumination signals ϕI1 to ϕI20 are arranged in ascending order, the order of the PINs assigned to the illumination signals ϕI1 to ϕI20 may be changed so that the illumination-signal lines 204-1 to 204-20 can be easily provided on the light-emitting-chip mount board 62.

FIG. 5B illustrates portions of the light-emitting-device driving circuit 33, the connector 34, the cable 35, the connector 68, and the light-emitting-chip mount board 62 that are portions which are associated with the PINs #27 to #33 and that are used to transmit the illumination signals ϕI15 to ϕI18.

As illustrated in FIG. 5B, regarding the group IIIa used to transmit the illumination signals ϕI1 to ϕI20, two illumination signals ϕI (for example, the illumination signals ϕI15 and ϕI16, and the illumination signals ϕI17 and ϕI18) are transmitted in a state in which the PINs assigned to the illumination signals ϕI are positioned between the PINs assigned to the reference potential Vsub.

As described below, in the present exemplary embodiment, the illumination signals ϕI have negative potentials. As indicated by the arrows illustrated in FIG. 5B, currents flow from the reference potential Vsub to the negative potentials of the illumination signals ϕI. In other words, the light-emitting-device driving circuit 33 pulls currents, whereby the light emitting thyristors L perform illumination.

Thus, currents that flow through the light emitting thyristors L are supplied, from portions that are portions of the light-emitting-device driving circuit 33 and that supply the reference potential Vsub, to the light emitting thyristors L of the light emitting chips C, via the connector 34, the cable 35, and the connector 68 in this order. The currents flow, from the light emitting thyristors L, to portions that are portions of the light-emitting-device driving circuit 33 and that supply the illumination signals ϕI, via the connector 68, the cable 35, and the connector 34 in this order.

In the present exemplary embodiment, the PINs assigned to the reference potential Vsub are provided in the connector 34, the cable 35, and the connector 68 so as to be adjacent to the PINs assigned to the illumination signals ϕI. Accordingly, current loops CL are small, so that the inductances of the wiring patterns through which the illumination signals ϕI are transmitted are reduced. Thus, occurrence of noise can be reduced. Furthermore, for all of the illumination signals ϕI, the positional relationships between the PINs assigned to the illumination signals ϕI and the PINs assigned to the reference potential Vsub are the same in the PIN arrangement. Accordingly, the characteristic impedances of the individual illumination signals ϕI are almost the same. Thus, for all of the illumination signals ϕI, occurrence of differences between the amounts of generated noise is reduced.

Furthermore, in the present exemplary embodiment, the first transfer signal ϕ1 is transmitted using the PINs belonging to the group IIa, and the second transfer signal ϕ2 is transmitted using the PINs belonging to the group IVa. A single signal is transmitted as each of the first transfer signal ϕ1 and the second transfer signal ϕ2.

Note that, regarding the group Ia used to transmitting light-amount correction data items, for example, an $I^2C$ bus is illustrated. The $I^2C$ bus is a bus for synchronous serial communication that is performed using two signal lines (not including GND), i.e., a signal line called SCL (serial clock) and a signal line called SDA (serial data) which is used for bidirectional communication. Note that a signal called write control (WC) is a signal for control of writing light-amount correction data items into the light-amount-correction-data memory 67 such as an EEPROM.

Furthermore, a serial peripheral interface (SPI) bus or the like may be used. The SPI bus is a bus for synchronous serial communication that is performed using four signal lines (not including GND), i.e., a signal line called SCK (serial clock) and signal lines called SDI, SDO, and CS which are used for unidirectional communication.

Figures 6A, 6B:
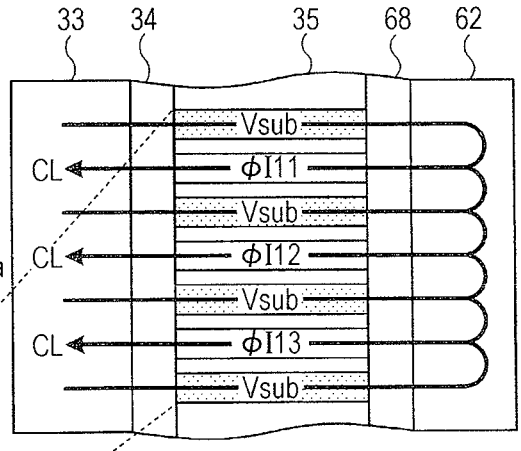
FIGS. 6A and 6B are diagrams illustrating another example of the PIN arrangement of the connector.

FIGS. 6A and 6B are diagrams illustrating another example of the PIN arrangement of the connector 68. FIG. 6A is a diagram of the PIN arrangement of the connector 68. FIG. 6B is a diagram in which the PIN arrangement of the PINs assigned to the illumination signals ϕI is illustrated so as to be enlarged. Note that, in FIG. 6B, the light-emitting-device driving circuit 33, the connector 34, and the light-emitting-chip mount board 62 are also illustrated. The difference between the PIN arrangement illustrated in FIGS. 6A and 6B and the PIN arrangement illustrated in FIGS. 5A and 5B is arrangement of the group IIIa of the PINs #6 to #49 that are used to transmit the illumination signals ϕI1 to ϕI20. Hereinafter, the difference between FIGS. 6A and 6B and FIGS. 5A and 5B will be described, and a description of portions common to both FIGS. 6A and 6B and FIGS. 5A and 5B will be omitted.

As illustrated in FIG. 6A, the connector 68 includes, for example, fifty terminals (PINs).

FIG. 6B illustrates portions of the light-emitting-device driving circuit 33, the connector 34, the cable 35, the connector 68, and the light-emitting-chip mount board 62 that are portions which are associated with the PINs #26 to #32 and which are used to transmit the illumination signals ϕI11 to ϕI13. As illustrated in FIG. 6B, regarding the group IIIa used to transmit the illumination signals ϕI1 to ϕI20, one illumination signal ϕI (for example, in FIG. 6B, each of the illumination signals ϕI11 to ϕI13) is transmitted in a state in which the PIN assigned to the illumination signal ϕI is positioned between the PINs assigned to the reference potential Vsub.

Also in the PIN arrangement illustrated in FIGS. 6A and 6B, as in the case of the PIN arrangement illustrated in FIGS. 5A and 5B, current loops CL are small, so that the inductances of wiring patterns through which the illumination signals ϕI are transmitted are reduced. Thus, occurrence of noise can be reduced. Furthermore, for all of the illumination signals ϕI, the positional relationships between the PINs assigned to the illumination signals ϕI and the PINs assigned to the reference potential Vsub are the same in the PIN arrangement. Thus, the characteristic impedances of the individual illumination signals ϕI are almost the same. Thus, for all of the illumination signals ϕI, occurrence of differences between the amounts of generated noise is reduced.

Note that, regarding the group IIIa illustrated in FIG. 6A, although the PINs assigned to the illumination signals ϕI1 to ϕI20 are arranged in ascending order, the order of the PINs assigned to the illumination signals ϕI1 to ϕI20 may be changed so that the illumination-signal lines 204-1 to 204-20 can be easily provided on the light-emitting-chip mount board 62.

(Light-Amount-Correction-Data Memory 67)

Next, the light-amount-correction-data memory 67 will be described.

Figure 7:
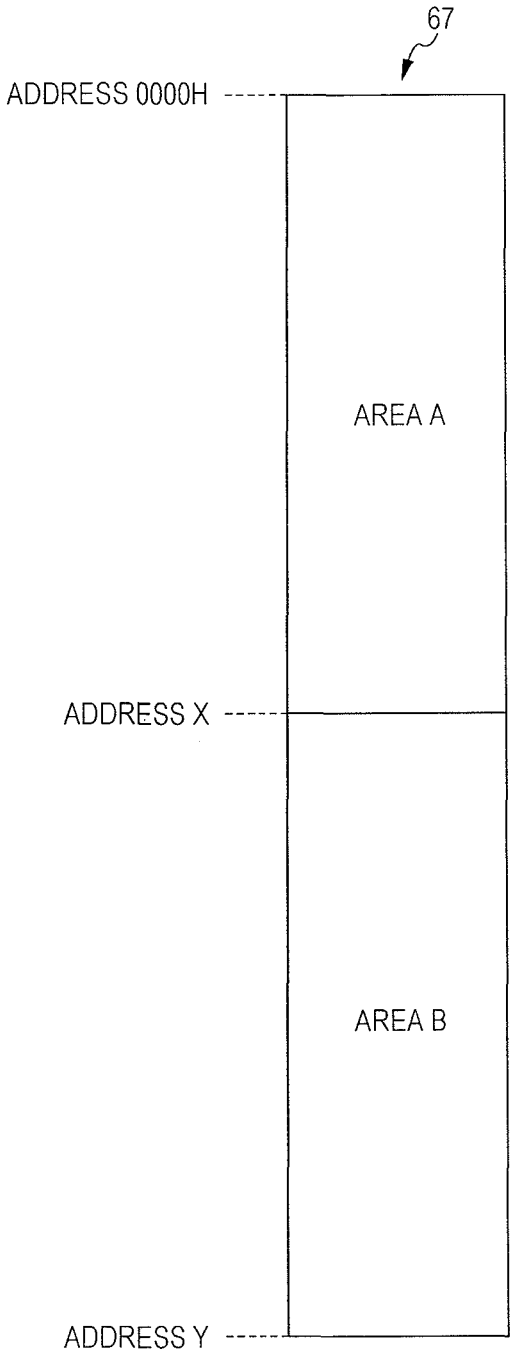
FIG. 7 is a diagram illustrating an example of a configuration of a light-amount-correction-data memory.

FIG. 7 is a diagram illustrating an example of a configuration of the light-amount-correction-data memory 67.

The light-amount-correction-data memory 67 is constituted by a non-volatile memory such as an EEPROM as described above. In the present exemplary embodiment, as illustrated in FIG. 7, a storage region (a memory area) of the light-amount-correction-data memory 67 is divided into at least two areas (an area A and an area B) that have different addresses. Light-amount correction data items that are set in accordance with a condition 1 for use and a condition 2 for use of the light emitting device 65 which are determined in advance are stored in the area A (an address 0000H to an address X) and the area B (the address X to an address Y), respectively. In other words, in a case of using the light emitting device 65 under the condition 1 for use, a start address is set to be the address 0000H, and the light-amount correction data items stored in the area A are read. In contrast, in a case of using the light emitting device 65 under the condition 2 for use, the start address is set to be the address X, and the light-amount correction data items stored in the area B are read.

For example, it is supposed that the condition 1 for use is a condition for monochrome printing, and that the condition 2 for use is a condition for color printing. In a case of monochrome printing, deterioration in image quality caused by the differences between the amounts of light is not pronounced. Accordingly, a processing time taken to correct the amounts of light can be reduced by reducing the number of bits of the light-amount correction data items stored in the area A. In contrast, in a case of color printing, deterioration in image quality caused by the differences between the amounts of light easily occurs. Accordingly, an accuracy with which the amounts of light are corrected can be increased by increasing the number of bits of the light-amount correction data items stored in the area B.

Note that, although the memory area of the light-amount-correction-data memory 67 is divided into two areas (the areas A and B) in the present exemplary embodiment, the memory area may be divided into three or more areas. It is not necessarily necessary that the sizes of the individual areas be the same if each of the sizes is equal to or larger than a size that is necessary and sufficient for a condition for use of the light emitting device 65.

As described below, in the present exemplary embodiment, for each of the light emitting thyristors L, correction of an amount of light is performed by controlling a time period (an illumination time period) in which the light emitting thyristor L is caused to perform illumination. Note that correction of an amount of light may be performed by controlling the current that is caused to flow the light emitting thyristor L, instated of the method for controlling the illumination time period.

Furthermore, regarding the light-amount correction data items, a common value may be used for the multiple light emitting thyristors L (for example, two light emitting thyristors that are the light emitting thyristors L1 and L2) that are adjacent to each other. Because the difference between light emission intensities of the light emitting thyristors L adjacent to each other is small, for example, a common light-amount correction data item may be used as the average value of the individual light-amount correction data items. Accordingly, the size of a portion that is a portion of the memory area and that is occupied by the light-amount correction data items is reduced in the light-amount-correction-data memory 67, so that a processing time taken to correct the amounts of light can be reduced.

For example, when twenty light emitting chips C including 256 light emitting thyristors L are used, it is supposed that the light-amount correction data items are eight-bit data items (256 levels). When one light-amount correction data item is shared by two light emitting thyristors L adjacent to each other, the size of the light-amount correction data items is 2560 (A00H) bytes. At least 2560 (A00H) bytes or larger are necessary as the size of the area A.

In contrast, in a case of preparing a light-amount correction data item for each of the light emitting thyristors L, the size of the light-amount correction data items is 5120 (1400 H) bytes. In this case, at least 5120 (1400 H) bytes or larger are necessary as the size of the area A. The start address of the area B is set to be 1400 H or a value that is equal to or larger than 1400 H.

In the description given above, the light-amount-correction-data memory 67 stores the light-amount correction data items. However, the light-amount correction data items are examples. The light-amount-correction-data memory 67 may store control data items including light-amount correction data items (correction values) that are set so as to correspond to multiple driving units which drive the light emitting device 65.

(Light Emitting Chip C)

Figure 8:
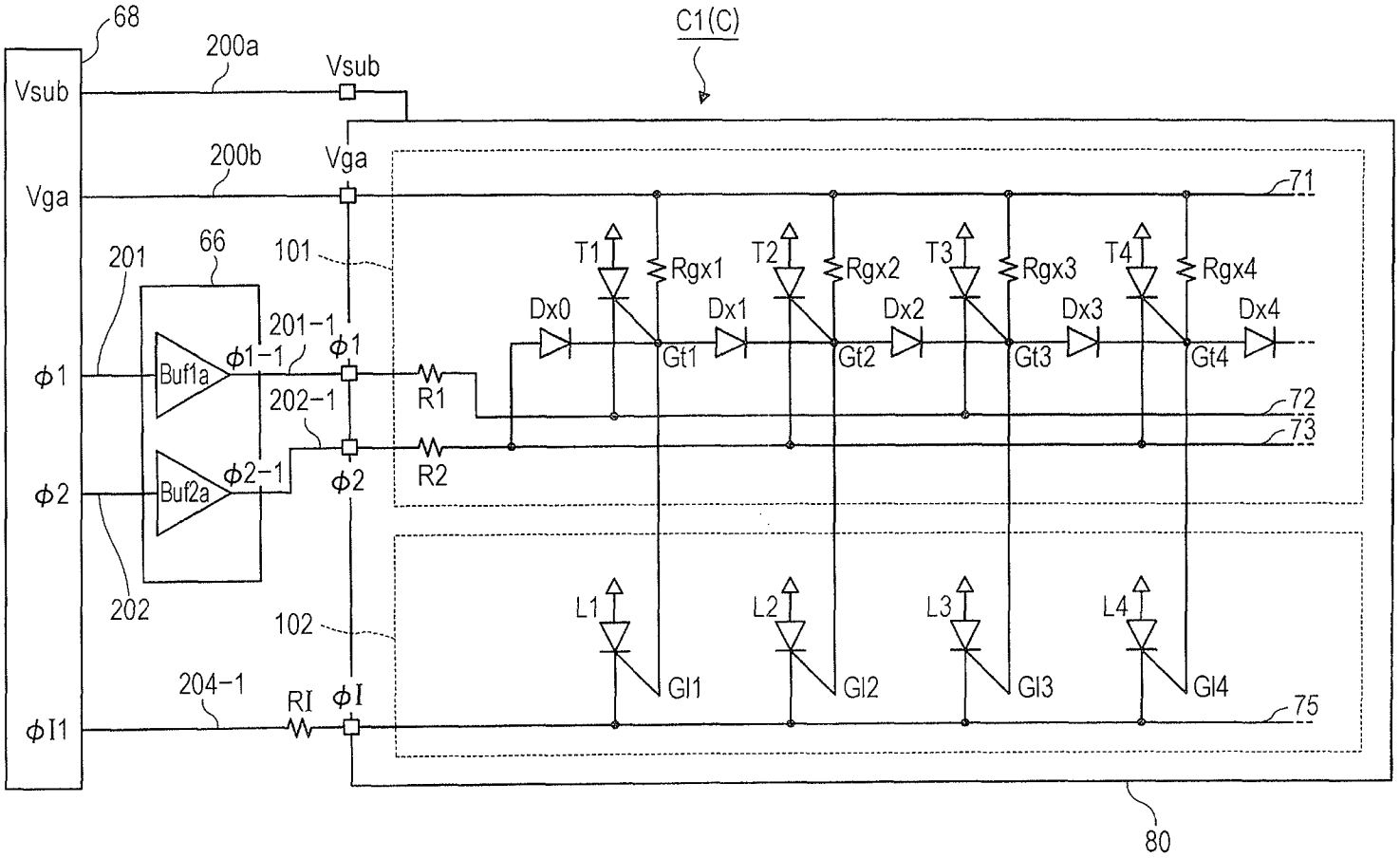
FIG. 8 is an equivalent circuit diagram illustrating a circuit configuration of each of the light emitting chips in which a self-scanning light emitting device (SLED) is mounted.

FIG. 8 is an equivalent circuit diagram illustrating a circuit configuration of the light emitting chip C in which a self-scanning light emitting device (SLED) is mounted. Individual elements that will be described below are disposed in accordance with a layout of the light emitting chip C excluding positions at which the terminals (the ϕ1 terminal, the ϕ2 terminal, the Vga terminal, and the ϕI terminal) are provided. Note that, for convenience of description, the positions of the terminals (the ϕ1 terminal, the ϕ2 terminal, the Vga terminal, and the ϕI terminal) are illustrated at the left end of FIG. 8, although the positions thereof are different from the positions thereof illustrated in FIG. 3B. The rear-surface electrode (the Vsub terminal) that is provided on the rear surface of the board 80 is illustrated so as to lead out to the outside of the board 80.

Here, in order to describe the light emitting chip C on the basis of the relationship with the connector 68, the light emitting chip C1 is described as an example. For this reason, in FIG. 8, the light emitting chip C is represented as a "light emitting chip C1 (C)". Note that the configuration of each of the other light emitting chips C2 to C20 is the same as that of the light emitting chip C1.

In FIG. 8, portions that are portions of the transfer-signal supply circuit 66 and the connector 68 and that are associated with the light emitting chip C1 are extracted and illustrated.

The light emitting chip C1 (C) includes a light-emitting-thyristor row (the light emitting section 102 (see FIG. 3B)) that serves as an example of a light-emitting-element row which is constituted by the light emitting thyristors L1, L2, L3, . . . that are disposed in a row on the board 80 as described above.

The light emitting chip C1 (C) includes a transfer-thyristor row that serves as an example of a transfer-element row which is constituted by transfer thyristors T1, T2, T3, . . . that serve as examples of transfer elements which are disposed in a row as in the case of the light-emitting-thyristor row.

Furthermore, the light emitting chip C1 (C) includes coupling diodes Dx1, Dx2, Dx3, . . . that are provided between each pair of transfer thyristors which is obtained by sequentially pairing, in numerical order, two transfer thyristors among the transfer thyristors T1, T2, T3, . . . .

Additionally, the light emitting chip C1 (C) includes resisters Rgx1, Rgx2, Rgx3, . . . .

Moreover, the light emitting chip C1 (C) includes one start diode Dx0. The light emitting chip C1 (C) includes current limiting resistors R1 and R2 that are provided in order to prevent excessive amounts of currents from flowing through a first-transfer-signal line 72 and a second-transfer-signal line 73, which are described below. The first transfer signal ϕ1 is transmitted through the first-transfer-signal line 72, and the second transfer signal ϕ2 is transmitted through the second-transfer-signal line 73.

The light emitting thyristors L1, L2, L3, . . . in the light-emitting-thyristor row and the transfer thyristors T1, T2, T3, . . . in the transfer-thyristor row are disposed in numerical order from the left side of FIG. 8. Furthermore, the coupling diodes Dx1, Dx2, Dx3, . . . and the resisters Rgx1, Rgx2, Rgx3, . . . are also disposed in numerical order from the left side of FIG. 8.

The light-emitting-thyristor row and the transfer-thyristor row are arranged in an order of the transfer-thyristor row and the light-emitting-thyristor row from the top of FIG. 8.

Here, when the transfer thyristors T1, T2, T3, . . . , the coupling diodes Dx1, Dx2, Dx3, . . . , and the resisters Rgx1, Rgx2, Rgx3 . . . are not distinguished from one another, the transfer thyristors T1, T2, T3, . . . , the coupling diodes Dx1, Dx2, Dx3, . . . , and the resisters Rgx1, Rgx2, Rgx3 . . . are referred to as "transfer thyristors T", "coupling diodes Dx", and "resisters Rgx", respectively.

The number of light emitting thyristors L in the light-emitting-thyristor row may be a predetermined number. In the present exemplary embodiment, when it is supposed that the number of light emitting thyristors L is 256, the number of transfer thyristors T is also 256. Similarly, the number of resisters Rgx is also 256. However, the number of coupling diodes Dx is 255 that is one fewer than the number of transfer thyristors T.

Note that the number of transfer thyristors T may be larger than the number of light emitting thyristors L.

Next, electrical connections between the individual elements in the light emitting chip C1 (C) will be described.

Each of the light emitting thyristors L and the transfer thyristors T is a semiconductor element having three terminals, i.e., a gate terminal, an anode terminal, and a cathode terminal.

The anode terminal of each of the light emitting thyristors L and the transfer thyristors T is connected to the board 80 of the light emitting chip C1 (C) (anode common).

The anode terminals are connected to the potential line 200*a* via the rear-surface electrode 85 (the Vsub terminal) that is provided on the rear surface of the board 80. The reference potential Vsub is supplied to the potential line 200*a* from the light-emitting-device driving circuit 33 via the connector 68.

The cathode terminals of the odd-numbered transfer thyristors T1, T3, . . . are connected to the first-transfer-signal line 72 along the arrangement of the transfer thyristors T. The first-transfer-signal line 72 is connected to the ϕ1 terminal via the current limiting resistor R1. The first-transfer-signal line 201-1 is connected to the ϕ1 terminal, and is connected to the output terminal of the buffer circuit Buf1*a* of the transfer-signal supply circuit 66. The input terminal of the buffer circuit Buf1*a* is connected to the connector 68 via the first-transfer-signal line 201. The first transfer signal ϕ1 is transmitted from the light-emitting-device driving circuit 33 through the first-transfer-signal line 201, and the first transfer signal ϕ1-1 is transmitted through the first-transfer-signal line 201-1. In other words, the first transfer signal ϕ1-1 is transmitted to the ϕ1 terminal.

In contrast, the cathode terminals of the even-numbered transfer thyristors T2, T4, . . . are connected to the second-transfer-signal line 73 along the arrangement of the transfer thyristors T. The second-transfer-signal line 73 is connected to the ϕ2 terminal via the current limiting resistor R2. The second-transfer-signal line 202-1 is connected to the ϕ2 terminal, and is connected to the output terminal of the buffer circuit Buf2*a* of the transfer-signal supply circuit 66. The input terminal of the buffer circuit Buf2*a* is connected to the connector 68 via the second-transfer-signal line 202. The second transfer signal ϕ2 is transmitted from the light-emitting-device driving circuit 33 through the second-transfer-signal line 202, and the second transfer signal ϕ2-1 is transmitted through the second-transfer-signal line 202-1. In other words, the second transfer signal ϕ2-1 is transmitted to the ϕ2 terminal.

The cathode terminals of the light emitting thyristor L1, L2, L3, . . . are connected to an illumination-signal line 75. The illumination-signal line 75 is connected to the ϕI terminal. In the light emitting chip C1, the ϕI terminal is connected to the illumination-signal line 204-1 via the current limiting resistor R1, and the illumination signal ϕI1 is transmitted to the ϕI terminal from the light-emitting-device driving circuit 33 via the connector 68. The illumination signal ϕI1 is used to supply currents for performing illumination to the light emitting thyristor L1, L2, L3, . . . of the light emitting chip C1. Note that the ϕI terminals of the other light emitting chips C2 to C20 are connected to the illumination-signal lines 204-2 to 204-20, respectively, via the current limiting resistors R1, and the illumination signals ϕI2 to ϕI20 are transmitted to the ϕI terminals.

Gate terminals Gt1, Gt2, Gt3, . . . of the transfer thyristors T1, T2, T3, . . . are connected to gate terminals G11, G12, G13, . . . of the light emitting thyristors L1, L2, L3, . . . that are the same-numbered elements, respectively, in a one-to-one manner. Accordingly, potentials at the same-numbered gate terminals among the gate terminals Gt1, Gt2, Gt3, . . . and the gate terminals G11, G12, G13, . . . are electrically the same. Thus, for example, the term "gate terminal Gt1 (gate terminal G11)" indicates that a potential at the gate terminal Gt1 and a potential at the gate terminal G11 are the same.

Here, also when the gate terminals Gt1, Gt2, Gt3, . . . and the gate terminals G11, G12, G13, . . . are not distinguished from one another, the gate terminals Gt1, Gt2, Gt3, . . . and the gate terminals G11, G12, G13, . . . are referred to as "gate terminals Gt" and "gate terminals G1", respectively. The term "gate terminals Gt (gate terminals G1)" indicates that potentials at the gate terminals Gt and potentials at the gate terminals G1 are the same.

The coupling diodes Dx1, Dx2, Dx3, . . . are connected between pairs of the gate terminals Gt that are obtained by sequentially pairing, in numerical order, two gate terminals among the gate terminals Gt1, Gt2, Gt3, . . . of the individual transfer thyristors T1, T2, T3, . . . . In other words, the individual coupling diodes Dx1, Dx2, Dx3, . . . are connected in series so as to be sequentially sandwiched between the gate terminals Gt1, Gt2, Gt3, . . . . Regarding the direction of the coupling diode Dx1, the coupling diode Dx1 is connected so as to be oriented to a direction in which a current flows from the gate terminal Gt1 to the gate terminal Gt2. The other coupling diodes Dx2, Dx3, Dx4, . . . are connected in the same manner.

The gate terminals Gt (the gate terminals G1) of the transfer thyristors T are connected to a potential line 71 via the resisters Rgx that are provided so as to correspond to the individual transfer thyristors T. The potential line 71 is connected to the Vga terminal so as to be connected to the potential line 200*b*. The potential Vga is supplied to the potential line 200*b* from the light-emitting-device driving circuit 33 via the connector 68.

The gate terminal Gt1 of the transfer thyristor T1 that is provided on one end side of the transfer-thyristor row is connected to a cathode terminal of the start diode Dx0. In contrast, an anode terminal of the start diode Dx0 is connected to the second-transfer-signal line 73.

Referring to FIG. 8, a portion that is a portion of the light emitting chip C1 (C) and that includes the transfer thyristors T, the coupling diodes Dx, the resisters Rgx, the start diode Dx0, and the current limiting resistors R1 and R2 is referred to as a "transfer section 101". As described above, a portion that includes the light emitting thyristors L is the light emitting section 102.

(Operation of Light Emitting Device 65)

Next, an operation of the light emitting device 65 will be described.

As described above, the light emitting device 65 includes the light emitting chips C1 to C20 (see FIGS. 3A, 3B, and 4).

As illustrated in FIG. 4, the reference potential Vsub and the potential Vga are supplied as common signals to all of the light emitting chips C1 to C20 on the light-emitting-chip mount board 62. As described above, the waveform of each of the first transfer signals ϕ1-1, ϕ1-2, ϕ1-3, and ϕ1-4 that are transmitted to a corresponding one of the light-emitting-chip groups #1 to #4 is the same as that of the first transfer signal ϕ1. Similarly, the waveform of each of the second transfer signals ϕ2-1, ϕ2-2, ϕ2-3, and ϕ2-4 that are transmitted to a corresponding one of the light-emitting-chip groups #1 to #4 is the same as that of the second transfer signal ϕ2. In other words, the signals (the first transfer signals ϕ1-1, ϕ1-2, ϕ1-3, and ϕ1-4) having a waveform that is the same as the waveform of the first transfer signal ϕ1 and the signals (the second transfer signals ϕ2-1, ϕ2-2, ϕ2-3, and ϕ2-4) having a waveform that is the same as the waveform of the second transfer signal ϕ2 are transmitted as common signals (in parallel) to the light emitting chips C1 to C20.

In contrast, the illumination signals ϕI1 to ϕI20 are individually transmitted to the respective light emitting chips C1 to C20. The illumination signals ϕI1 to ϕI20 are signals for setting the light emitting thyristors L of the respective light emitting chips C1 to C20 so that the light emitting thyristors L perform illumination or non-illumination. Thus, the waveforms of the illumination signals ϕI1 to ϕI20 are different from one another in accordance with the image data item.

As described above, because the light emitting chips C1 to C20 are driven in parallel, it will be sufficient to only describe the operation of the light emitting chip C1.

(Thyristors)

Before the operation of the light emitting chip C1 is described, the basic operation of a thyristor (each of the transfer thyristors T and the light emitting thyristors L) will be described. The thyristor is a semiconductor element having a pnpn structure in which a p-type semiconductor layer and an n-type semiconductor layer are repeatedly stacked in a compound semiconductor such as GaAs or GaAlAs. As described above, the thyristor has three terminals, i.e., an anode terminal, a cathode terminal, and a gate terminal. It is supposed that a forward potential (a diffusion potential) of a p-n junction in the thyristor is, for example, about 1.5 V.

Hereinafter, for example, it is supposed that the reference potential Vsub supplied to the rear-surface electrode 85 (the Vsub terminal) of the light emitting chip C is 0 V as a high-level potential (hereinafter, referred to as "H"), and that the potential Vga supplied to the Vga terminal is −3.3 V as a low-level potential (hereinafter, referred to as "L").

The potential at the anode terminal of the thyristor is the reference potential Vsub ("H" (0 V)) that is supplied to the rear-surface electrode 85.

In the present exemplary embodiment, the light emitting device 65 is driven using a negative potential. Note that, the transfer-signal supply circuit 66 and the light-emitting-device driving circuit 33 may be driven using a positive potential that is determined by shifting the potential Vga (−3.3 V) to GND (0 V) and shifting the reference potential Vsub (0 V) to Vcc (3.3 V).

Figure 9A:
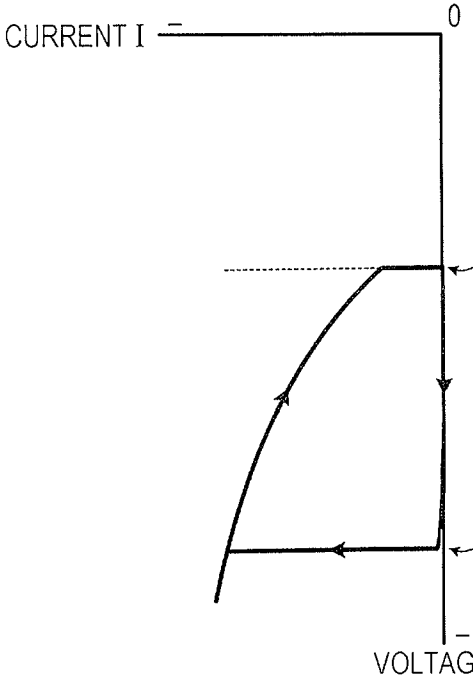
FIGS. 9A and 9B are diagrams illustrating an operation in a case in which a thyristor is driven by buffer circuits.
Figure 9B:
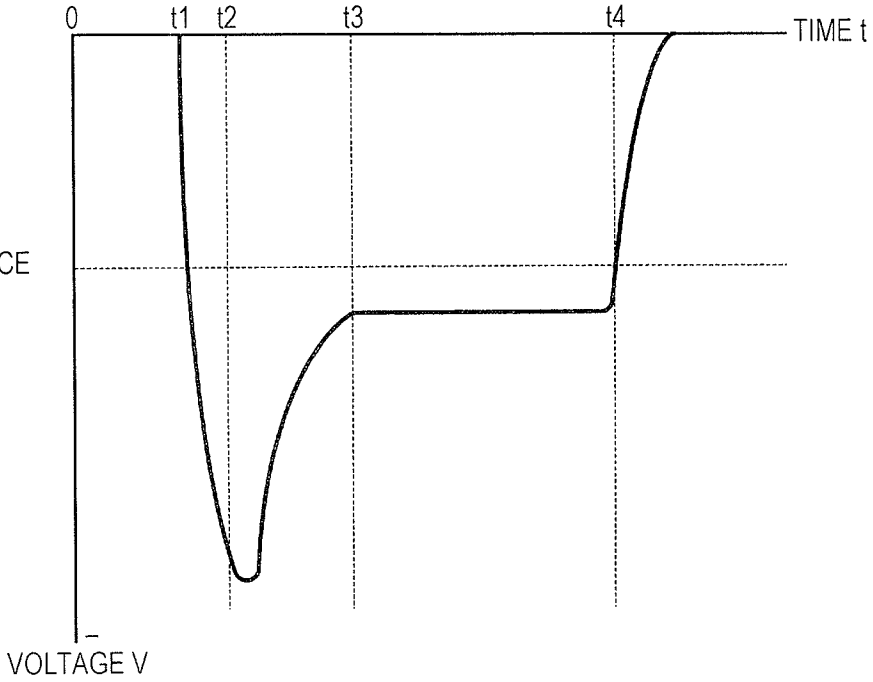

FIGS. 9A and 9B are diagrams illustrating an operation of the thyristor in a case in which the thyristor is driven by the buffer circuits Buf1*a* to Buf8*a*. FIG. 9A illustrates current-I-voltage-V characteristics of the cathode terminal (between the anode terminal and the cathode terminal) of the thyristor. FIG. 9B illustrates change in the voltage V of the cathode terminal (between the anode terminal and the cathode terminal) of the thyristor for a time t. Note that, because the potential at the anode terminal is the reference potential Vsub ("H" (0V)), hereinafter, the potential at the cathode terminal is described.

Regarding the thyristor (a time t1 illustrated in FIG. 9B) that is in an off-state in which the potential at the cathode terminal is the reference potential Vsub ("H" (0V)), and in which no current flows between the anode terminal and the cathode terminal, when a potential that is lower than a threshold voltage (a negative value whose absolute value is large) is applied to the cathode terminal, the thyristor enters an on-state (is turned on) (a time t2 illustrated in FIG. 9B).

Here, the threshold voltage of the thyristor is a voltage which is applied to the cathode terminal, and whose absolute value is the minimum among the absolute values of voltages that can cause the thyristor to shift from the off-state to the on-state. The threshold voltage of the thyristor is a value that is obtained by subtracting a forward potential Vd (about 1.5 V) of the p-n junction from the potential at the gate terminal. Thus, when the potential at the gate terminal is about 0 V, the threshold voltage is about −1.5 V. In other words, when a potential (a potential whose absolute value is large on the negative side) that is lower than about −1.5 V is applied to the cathode terminal, the thyristor is tuned on. Furthermore, when the potential at the gate terminal is about −1.5 V, the threshold voltage is about −3 V.

When the thyristor is turned on, the thyristor enters a state (the on-state) in which a current I flows between the anode terminal and the cathode terminal. When the thyristor enters the on-state, the potential at the gate terminal becomes a potential that is closer to the potential at the anode terminal. Here, it is supposed that the potential at the gate terminal becomes about 0 V because the potential at the anode terminal is set to be the reference potential Vsub ("H" (0V)). Furthermore, the potential at the cathode terminal of the thyristor in the on-state is increased due to the output impedance and the on-state current of the driven circuit so as to be higher than a potential at the time at which the thyristor is turned on (a time t3 illustrated in FIG. 9B).

Regarding the thyristor, a potential (a negative value whose absolute value is large) that is lower than about −1.5 V (a maintenance voltage) which is a value obtained by subtracting the forward potential Vd (about 1.5 V) of the p-n junction from the potential ("H" (0V)) at the anode terminal of the thyristor is continuously applied to the cathode terminal thereof. When a current (a maintenance current) that can cause the on-state of the thyristor to be maintained is supplied, the on-state is maintained (a time period from the time t3 to a time t4 illustrated in FIG. 9B).

Regarding the thyristor, when the potential at the cathode thereof is a potential (a negative value whose absolute value is small, 0 V, or a positive value) that is higher than the maintenance voltage which is necessary to maintain the on-state, i.e., when a potential that is higher than about −1.5 V is applied to the cathode terminal thereof, the thyristor enters the off-state (is turned off) (the time t4 illustrated in FIG. 9B). For example, when the potential at the cathode terminal becomes "H" (0 V), the potential at the cathode is a potential that is higher than about −1.5 V, and the potential at the cathode terminal and the potential at the anode terminal become the same. Accordingly, the thyristor is turned off.

When the light emitting thyristor L is turned on, the light emitting thyristor L performs illumination (emission of light), and when the light emitting thyristor L is turned off, the light emitting thyristor L stops emission of light (performs non-illumination). The brightness (the luminous flux (the amount of light per unit time)) of the light emitting thyristor L in the on-state is determined in accordance with the area of the light emitting region of the light emitting thyristor L and a current that flows between the anode terminal and the cathode terminal of the light emitting thyristor L.

<Timing Chart>

Figure 10:
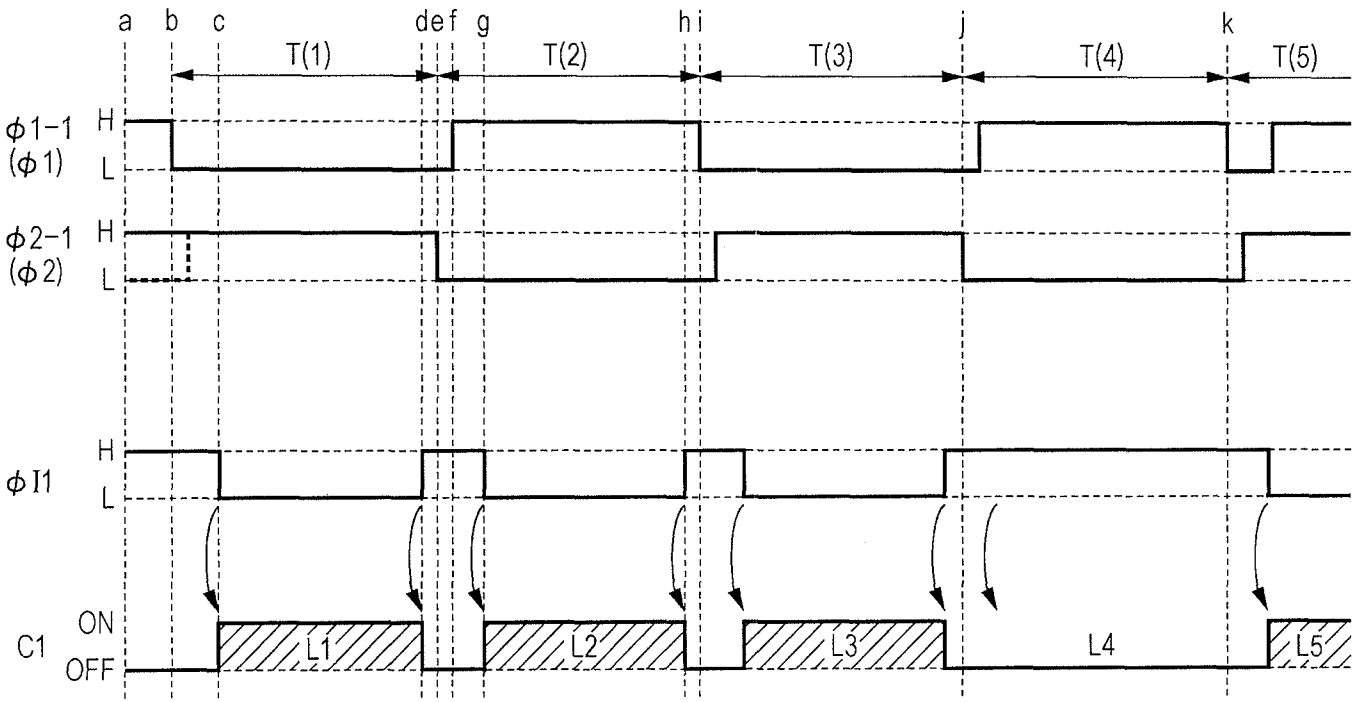
FIG. 10 is a timing chart for explaining operations of the light emitting device and the light emitting chip.

FIG. 10 is a timing chart for explaining the operations of the light emitting device 65 and the light emitting chip C.

FIG. 10 is a timing chart illustrating control of illumination or non-illumination (which is referred to as "illumination control") of five light emitting thyristors L that are the light emitting thyristors L1 to L5 of the light emitting chip C1. Because the other light emitting chips C2 to C20 operate in parallel with the light emitting chip C1 as described above, it will be sufficient to only describe the operation of the light emitting chip C1.

Note that, referring to FIG. 10, it is supposed that the light emitting thyristors L1, L2, L3, and L5 of the light emitting chip C1 are caused to perform illumination, and that the light emitting thyristor L4 is caused to stop emission of light (perform non-illumination).

Note that, regarding the light-amount correction data items, the start address (the address 0000H of the area A or the address X of the are B) at which reading of the light-amount correction data items starts is set in accordance with whether the condition 1 for use or the condition 2 for use is used (see FIG. 7).

In FIG. 10, it is supposed that the time elapses in alphabetical order from a time a to a time k. Control of illumination or non-illumination (illumination control) is performed on the light emitting thyristors L1, L2, L3, and L4 in a time period T(1) from a time b to a time e, a time period T(2) from the time e to a time i, a time period T(3) from the time i to a time j, and a time period T(4) from the time j to the time k, respectively. Hereinafter, similarly, illumination control is performed on the light emitting thyristors numbered five or higher.

In the present exemplary embodiment, it is supposed that the lengths of the time period T(1), T(2), T(3), . . . are the same. When the time period T(1), T(2), T(3), . . . are not distinguished from one another, the time period T(1), T(2), T(3), . . . are referred to as "time periods T".

Note that the lengths of the time period T(1), T(2), T(3), . . . may be changed as long as the relative relationships between signals described below are maintained.

The waveforms of the first transfer signal ϕ1-1, the second transfer signal ϕ2-1, and the illustration signal ϕI1 will be described. Note that the first transfer signal ϕ1-1 and the second transfer signal ϕ2-1 transmitted to the light emitting chip C1 are transmitted via the buffer circuits Buf1*a* and Buf2*a* (see FIG. 4), respectively. The first transfer signal ϕ1 and the second transfer signal ϕ2 are transmitted to the input terminals of the buffer circuits Buf1*a* and Buf2*a*, respectively. As described above, the first transfer signal ϕ1 and the first transfer signal ϕ1-1 are signals having the same waveform. Furthermore, the second transfer signal ϕ2 and the second transfer signal ϕ2-1 are signals having the same waveform. Thus, hereinafter, the first transfer signal ϕ1-1 is described as the first transfer signal ϕ1, and the second transfer signal ϕ2-1 is described as the second transfer signal ϕ2.

A time period from the time a to time b is a time period in which the light emitting chip C1 (the same is true for the light emitting chips C2 to C20) starts operating. Signals in this time period will be described in the description of the operation.

The first transfer signal ϕ1, which is transmitted to the ϕ1 terminal (see FIG. 8), and the second transfer signal ϕ2, which is transmitted to the ϕ2 terminal (see FIG. 8), are signals having two potentials, i.e., "H" and "L". Regarding the first transfer signal ϕ1 and the second transfer signal ϕ2, the waveforms thereof are repeated in units of two continuous time periods T (for example, a time period that is obtained by adding the time periods T(1) and T(2) to each other).

Regarding the first transfer signal ϕ1, the potential thereof is changed from "H" to "L" at the time b that is the start time of the time period T(1), and is changed from "L" to "H" at the time f. Then, the potential thereof is changed from "H" to "L" at the time i that is the end time of the time period T(2).

Regarding the second transfer signal ϕ2, the potential thereof is "H" at the time b that is the start time of the time period T(1), and is changed from "H" to "L" at the time e. Then, the potential thereof is maintained at "L" at the time i that is the end time of the time period T(2).

Here, the first transfer signal ϕ1 and the second transfer signal ϕ2 are compared with each other. The second transfer signal ϕ2 is a signal that is obtained by shifting the first transfer signal ϕ1 by the time period T backward along the temporal axis.

Regarding the first transfer signal ϕ1, the waveform thereof in the time period T(1) and the waveform thereof in the time period T(2) are repeated in the time period T(3) and thereafter. In contrast, regarding the second transfer signal ϕ2, the waveform thereof that is in the time period T(1) and that is indicated by the broken line and the waveform thereof in the time period T(2) are repeated in the time period T(3). The reason why the waveform of the second transfer signal ϕ2 in the time period T(1) is different from the waveform of the second transfer signal ϕ2 in the time period T(3) and thereafter is that the time period T(1) is a time period in which the light emitting device 65 starts operating.

As described below, a pair of transfer signals which is a pair of the first transfer signal ϕ1 and the second transfer signal ϕ2 causes the on-state to be transferred so that the transfer thyristors T illustrated in FIG. 8 enter the on-state in numerical order, thereby specifying the light emitting thyristors L that are numbered with the same numbers as the transfer thyristors T in the on-state as targets for control of illumination or non-illumination (illumination control).

Next, the illustration signal ϕI1 that is transmitted to the ϕI terminal of the light emitting chip C1 will be described. The illustration signal ϕI1 is a signal having the two potentials, i.e., "H" and "L". Note that the illustration signals ϕI2 to ϕI20 are transmitted to the other light emitting chips C2 to C20, respectively.

Here, the illustration signal ϕI1 in the time period T(1) of illumination control that is performed on the light emitting thyristor L1 of the light emitting chip C1 will be described. Note that it is supposed that the light emitting thyristor L1 is caused to perform illumination.

Regarding the illustration signal ϕI1, the potential thereof is "H" at the time b that is the start time of the time period T(1), and is changed from "H" to "L" at the time c. Then, the potential thereof is changed from "L" to "H" at the time d, and is maintained at "H" at the time e that is the end time of the time period T(1).

A time period from the time c to the time d, in which the potential of the illustration signal ϕI1 is "L", is an illumination time period in which the light emitting thyristor L1 performs illumination. The illumination time period is set on the basis of a light-amount correction data item stored in the light-amount-correction-data memory 67. In other words, the light-emitting-device driving circuit 33 reads a light-amount correction data item that is stored for the light emitting thyristor L1 of the light emitting chip C1. Then, the illumination time period is set on the basis of the light-amount correction data item. In this case, the time d, at which the potential of the illustration signal ϕI1 is returned to "H", may be fixed, and the time c, at which the potential of the illustration signal ϕI1 is changed to "L", may be set on the basis of the light-amount correction data item. Alternatively, the time c, at which the potential of the illustration signal ϕI1 is changed to "L", may be fixed, and the time d, at which the potential of the illustration signal ϕI1 is returned to "H", may be set. Alternatively, both the time c, at which the potential of the illustration signal ϕI1 is changed to "L", and the time d, at which the potential of the illustration signal ϕI1 is returned to "H", may be set.

Because correction of an amount of light is performed, the illumination time period (a time at which the potential of the illustration signal ϕI is changed to "L" (for example, the time c for the illustration signal ϕI1 illustrated in FIG. 10) or/and a time at which the potential of the illustration signal ϕI is changed to "H" (for example, the time d for the illustration signal ϕI1 illustrated in FIG. 10)) differs in accordance with each of the light emitting thyristors L of each of the light emitting chips C.

The operations of the light emitting device 65 and the light emitting chip C1 will be described in accordance with the timing chart illustrated in FIG. 10, while referring to FIGS. 4, 5A and 5B, 6A and 6B, 7, and 8. Note that, hereinafter, the time periods T(1) and T(2) in which illumination control is performed on the light emitting thyristors L1 and L2 will be described.

(1) Time a

<Light Emitting Device 65>

At the time a, the light-emitting-device driving circuit 33 sets the reference potential Vsub to be "H" (0V), and sets the potential Vga to be "L" (−3.3 V). Then, the potential line 200*a* on the light-emitting-chip mount board 62 of the light emitting device 65 is set to be the reference potential Vsub that is "H" (0V). The Vsub terminal of each of the light emitting chips C1 to C20 is set to be "H". Similarly, the potential line 200*b* is set to be "L" (−3.3 V). The Vga terminal of each of the light emitting chips C1 to C20 is set to be "L". Accordingly, the potential line 71 of each of the light emitting chips C1 to C20 is set to be "L".

Then, the light-emitting-device driving circuit 33 sets each of the potentials of the first transfer signal ϕ1 and the second transfer signal ϕ2 to be "H". Then, the potentials of the first-transfer-signal line 201 and the second-transfer-signal line 202 become "H" (see FIG. 4). Accordingly, the potentials at the ϕ1 terminal and the ϕ2 terminal of each of the light emitting chips C1 to C20 become "H" via the transfer-signal supply circuit 66. Thus, the potential of the first-transfer-signal line 72 that is connected to the ϕ1 terminal via the current limiting resistor R1 also becomes "H", and the potential of the second-transfer-signal line 73 that is connected to the ϕ2 terminal via the current limiting resistor R2 also becomes "H" (see FIG. 8).

Furthermore, the light-emitting-device driving circuit 33 sets each of the potentials of the illustration signals ϕI1 to ϕI20 to be "H". Then, the potentials of the illumination-signal lines 204-1 to 204-20 become "H" (see FIG. 4). Accordingly, the potential at the ϕI terminal of each of the light emitting chips C1 to C20 becomes "H" via a current limiting resistor R1. Thus, the potential of the illumination signal line 75 that is connected to the ϕI terminal also becomes "H" (see FIG. 8).

Next, the operation of the light emitting chip C1 will be described.

Note that, although it is supposed that the potential at each of the terminals changes stepwise in FIG. 10 and in the description given below, the potential at each of the terminals gradually changes. Thus, if conditions described below are satisfied even while a potential is changing, a thyristor may be turned on or turned off, so that a change in a state may occur.

<Light Emitting Chip C1>

Because the anode terminals of the transfer thyristors T and the light emitting thyristors L are connected to the Vsub terminal, the potentials at the anode terminals are set to be "H" (0 V).

The cathode terminal of each of the odd-numbered transfer thyristors T1, T3, T5, . . . is connected to the first-transfer-signal line 72, and set to be "H". The cathode terminal of each of the even-numbered transfer thyristors T2, T4, T6, . . . is connected to the second-transfer-signal line 73, and set to be "H". Thus, because both the potentials at the anode terminals of the transfer thyristors T and the potentials at the cathode terminals thereof are "H", the transfer thyristors T are in the off-state.

The cathode terminals of the light emitting thyristors L are connected to the illumination signal line 75 that is set to be "H". Thus, because both the potentials at the anode terminals of the light emitting thyristors L and the potentials at the cathode terminals thereof are "H", the light emitting thyristors L are also in the off-state.

As described above, the gate terminal Gt1 that is provided on one end side of the transfer-thyristor row illustrated in FIG. 8 is connected to the cathode terminal of the start diode Dx0. The gate terminal Gt1 is connected via the resister Rgx1 to the potential line 71 that is set to be the potential Vga ("L" (−3.3 V)). The anode terminal of the start diode Dx0 is connected to the second-transfer-signal line 73, so that the anode terminal of the start diode Dx0 is connected via the current limiting resistor R2 to the ϕ2 terminal at which the potential is "H" (0V). Thus, the start diode Dx0 is forward biased. The potential at the cathode terminal (the gate terminal Gt1) of the start diode Dx0 is a value (about −1.5 V) that is obtained by subtracting the forward potential Vd (about 1.5 V) of the p-n junction from the potential ("H" (0 V)) at the anode terminal of the start diode Dx0. Furthermore, when the potential at the gate terminal Gt1 becomes about −1.5 V, regarding the coupling diode Dx1, the potential at the anode terminal (the gate terminal Gt1) thereof becomes about −1.5 V, and the cathode terminal thereof is connected to the potential line 71 ("L" (−3.3 V)) via the resister Rgx2. Accordingly, the coupling diode Dx1 is forward biased. Thus, the potential at the gate terminal Gt2 becomes about −3 V that is obtained by subtracting the forward potential Vd (about 1.5 V) of the p-n junction from the potential (about −1.5 V) at the gate terminal Gt1. However, an influence of "H" (0 V) that is the potential at the anode terminal of the start diode Dx0 is not exerted on the gate terminals Gt that are numbered three or higher. The potential at each of the gate terminals Gt is "L" (−3.3 V) that is the potential of the potential line 71.

Note that, because the gate terminals Gt are connected to the gate terminals G1, the potentials at the gate terminals G1 are the same as those at the gate terminals Gt. Thus, the threshold voltages of the transfer thyristors T and the light emitting thyristors L are values that are obtained by subtracting the forward potential Vd (about 1.5 V) of the p-n junction from the potentials at the gate terminals Gt and G1. In other words, the threshold voltages of the transfer thyristor T1 and the light emitting thyristor L1 are about −3 V. The threshold voltages of the transfer thyristor T2 and the light emitting thyristor L2 are about −4.5 V. The threshold voltages of the transfer thyristors T and the light emitting thyristors L that are numbered three or higher are about −4.8 V.

(2) Time b

At the time b illustrated in FIG. 10, the potential of first transfer signal ϕ1 is changed from "H" (0 V) to "L" (−3.3 V). Accordingly, the light emitting device 65 starts operating.

When the potential of the first transfer signal ϕ1 is changed from "H" to "L", the potential of the first-transfer-signal line 72 is changed from "H" to "L" via the ϕ1 terminal and the current limiting resistor R1. Then, the transfer thyristor T1 whose threshold voltage is about −3 V is turned on. However, the transfer thyristors T whose cathode terminals are connected to the first-transfer-signal line 72 and which are numbered with odd numbers that are three or higher are not able to be turned on because the threshold voltages thereof are about −4.8 V. In contrast, the potential of the second-transfer-signal line 73 is "H" because the potential of the second transfer signal ϕ2 is "H" (0 V). Accordingly, the even-numbered transfer thyristors T are not able to be turned on. Because the transfer thyristor T1 is turned on, the potential of the first-transfer-signal line 72 is increased due to the output impedance and the on-state current of the driven circuit so as to be higher than a potential at the time at which the transfer thyristor T1 is turned on.

When the transfer thyristor T1 is turned on, the potential at the gate terminal Gt1 becomes about 0 V. The potential at the gate terminal Gt2 becomes about −1.5 V. The potential at the gate terminal Gt3 becomes about −3 V. The potentials at the gate terminals Gt that are numbered four or higher become "L" (−3.3 V).

Accordingly, the threshold voltage of the light emitting thyristor L1 becomes about −1.5 V. The threshold voltages of the transfer thyristor T2 and the light emitting thyristor L2 become about −3 V. The threshold voltages of the transfer thyristor T3 and the light emitting thyristor L3 become about −4.5 V. The threshold voltages of the transfer thyristors T and the light emitting thyristors L that are numbered four or higher become about −4.8 V.

However, because the transfer thyristor T1 is in the on-state, the potential of the first-transfer-signal line 72 is increased so as to be higher than about −3 V. Accordingly, the odd-numbered transfer thyristors T in the off-state are not turned on. Because the potential of the second-transfer-signal line 73 is "H", the even-numbered transfer thyristors T are not turned on. Because the potential of the illumination signal line 75 is "H", none of the light emitting thyristors L are turned on.

Immediately after the time b (when a stationary state is established after changes of the thyristors and so forth occur due to changes in the potentials of the signals at the time b), the transfer thyristor T1 is in the on-state, and the other transfer thyristors T and the light emitting thyristors L are in the off-state.

(3) Time c

At the time c, the potential of the illustration signal ϕI1 is changed from "H" to "L".

When the potential of the illustration signal ϕI1 is changed from "H" to "L", the potential of the illumination signal line 75 is changed from "H" to "L" via the current limiting resistor R1 and the ϕ1 terminal. Then, the light emitting thyristor L1 whose threshold voltage is about −1.5 V is turned on so as to perform illumination. Accordingly, the potential of the illumination signal line 75 is increased. Note that, although the threshold voltage of the light emitting thyristor L2 is about −3 V, the light emitting thyristor L2 is not turned on. The reason for this is that the potential of the illumination signal line 75 is increased so as to be higher than about −3 V because the light emitting thyristor L1 whose threshold voltage is about −1.5 V which is high (is a negative value whose absolute value is small) is turned on.

Immediately after the time c, the transfer thyristor T1 is in the on-state, and the light emitting thyristor L1 is in the on-state, so that the light emitting thyristor L1 performs illumination (emits light).

(4) Time d

At the time d, the potential of the illustration signal ϕI1 is changed from "L" to "H".

When the potential of the illustration signal ϕI1 is changed from "L" to "H", the potential of the illumination signal line 75 is changed from "L" to "H" via the current limiting resistor R1 and the ϕ1 terminal. Then, regarding the light emitting thyristor L1, because both the potential at the anode terminal thereof and the potential at the cathode terminal thereof become "H", the light emitting thyristor L1 is turned off so as to stop emission of light (perform non-illumination). The illumination time period of the light emitting thyristor L1 is a time period which is from the time c, at which the potential of the illustration signal ϕI1 is changed from "H" to "L", to the time d, at which the potential of the illustration signal ϕI1 is changed from "L" to "H", and in which the potential of the illustration signal ϕI1 is "L".

Immediately after the time d, the transfer thyristor T1 is in the on-state.

(5) Time e

At the time e, the potential of the second transfer signal ϕ2 is changed from "H" to "L". Here, the time period T(1), in which illumination control is performed on the light emitting thyristor L1, finishes, and the time period T(2), in which illumination control is performed on the light emitting thyristor L2, starts.

When the potential of the second transfer signal ϕ2 is changed from "H" to "L", the potential of the second-transfer-signal line 73 is changed from "H" to "L" via the ϕ2 terminal. As described above, because the threshold voltage of the transfer thyristor T2 becomes about −3 V, the transfer thyristor T2 is turned on. Accordingly, the potential at the gate terminal Gt2 (the gate terminal G12) becomes about 0 V. The potential at the gate terminal Gt3 (the gate terminal G13) becomes about −1.5 V. The potential at the gate terminal Gt4 (the gate terminal G14) becomes about −3 V. The potentials at the gate terminals Gt (the gate terminals G1) that are numbered five or higher become "L" (−3.3 V).

Immediately after the time e, the transfer thyristors T1 and T2 are in the on-state.

(6) Time f

At the time f, the potential of the first transfer signal ϕ1 is changed from "L" to "H".

When the potential of the first transfer signal ϕ1 is changed from "L" to "H", the potential of the first-transfer-signal line 72 is changed from "L" to "H" via the ϕ1 terminal. Then, regarding the transfer thyristor T1 in the on-state, because both the potential at the anode terminal thereof and the potential at the cathode terminal thereof become "H", the transfer thyristor T1 is turned off. Then, the potential at the gate terminal Gt1 (the gate terminal G11) is changed to the potential Vga ("L" (−3.3 V)) of the potential line 71 via the resister Rgx1. Accordingly, the coupling diode Dx1 enters a state (becomes reverse biased) in which a potential is applied in a direction in which no current flows. Thus, an influence of about 0 V that is the potential at the gate terminal Gt2 (the gate terminal G12) is not exerted on the gate terminal Gt1 (the gate terminal G11). In other words, regarding the transfer thyristors T having the gate terminals Gt that are connected by the coupling diodes Dx which are reverse biased, because the threshold voltages thereof become about −4.8 V, the transfer thyristors T are not turned on using the first transfer signal ϕ1 and the second transfer signal ϕ2 whose potentials are "L" (−3.3 V).

Immediately after the time f, the transfer thyristor T2 is in the on-state.

(7) Others

At the time g, when the potential of the illustration signal ϕI1 is changed from "H" to "L", the light emitting thyristor L2 is turned on as in the case of the light emitting thyristor L1 at the time c, so that the light emitting thyristor L2 performs illumination (emits light).

Then, at the time h, when the potential of the illustration signal ϕI1 is changed from "L" to "H", the light emitting thyristor L2 is turned off as in the case of the light emitting thyristor L1 at the time d, so that the light emitting thyristor L2 stops emission of light.

Furthermore, at the time i, when the potential of the illustration signal ϕI1 is changed from "H" to "L", the transfer thyristor T3 whose threshold voltage is about −3 V is turned on as in the case of the transfer thyristor T1 at the time b or the transfer thyristor T2 at the time e. At the time i, the time period T(2), in which illumination control is performed on the light emitting thyristor L2, finishes, and the time period T(3), in which illumination control is performed on the light emitting thyristor L3, starts.

Thereafter, the operation described above is repeated.

Note that, in a case of making the light emitting thyristors L keep stopping emission of light (performing non-illumination) without causing the light emitting thyristors L to perform illumination (emit light), the potentials of the illustration signals ϕI may be held at "H" (0 V), as in the case of the illustration signal ϕI1 in the time period T(4) which is illustrated in FIG. 10, in which illumination control is performed on the light emitting thyristor L4, and which is from the time j to the time k. In this manner, even when the threshold voltage of the light emitting thyristor L4 is about −1.5 V, the light emitting thyristor L4 is made to keep stopping emission of light (performing non-illumination).

As described above, the gate terminals Gt of the transfer thyristors T are connected to each other by the coupling diodes Dx. Thus, when the potential at a certain one of the gate terminals Gt has changed, the potential at the gate terminal Gt that is connected to the certain gate terminal Gt, at which the potential has changed, via the corresponding coupling diode Dx that is forward biased changes. Then, the threshold voltage of the corresponding transfer thyristor T having the certain gate terminal Gt, at which the potential has changed, changes. The transfer thyristor T is turned on at a time at which the threshold voltage thereof is higher than "L" (−3.3 V) (a negative value whose absolute value is small) and at which the potential of the first transfer signal ϕ1 or the second transfer signal ϕ2 is changed from "H" (0 V) to "L" (−3.3 V). In other words, the on-state is transferred (self-scanning is performed) so that the transfer thyristors T sequentially enter the on-state.

Then, regarding the light emitting thyristor L having the gate terminal G1 that is connected to the gate terminal Gt of the transfer thyristor T in the on-state, because the threshold voltage thereof is about −1.5 V, when the potential of the illustration signal ϕI is changed from "H" (0 V) to "L" (−3.3 V), the light emitting thyristor L is turned on so as to perform illumination (emit light).

In other words, the transfer thyristors T enter the on-state, thereby specifying the light emitting thyristors L that are targets for illumination control. The illustration signals ϕI are used to set the light emitting thyristors L, which are targets for illumination control, so as to perform illumination or non-illumination.

Accordingly, the waveforms of the illustration signals ϕI are set in accordance with the image data item, thereby controlling illumination or non-illumination of the individual light emitting thyristors L.

Next, a case in which the present exemplary embodiment is not used will be described.

Figure 11:
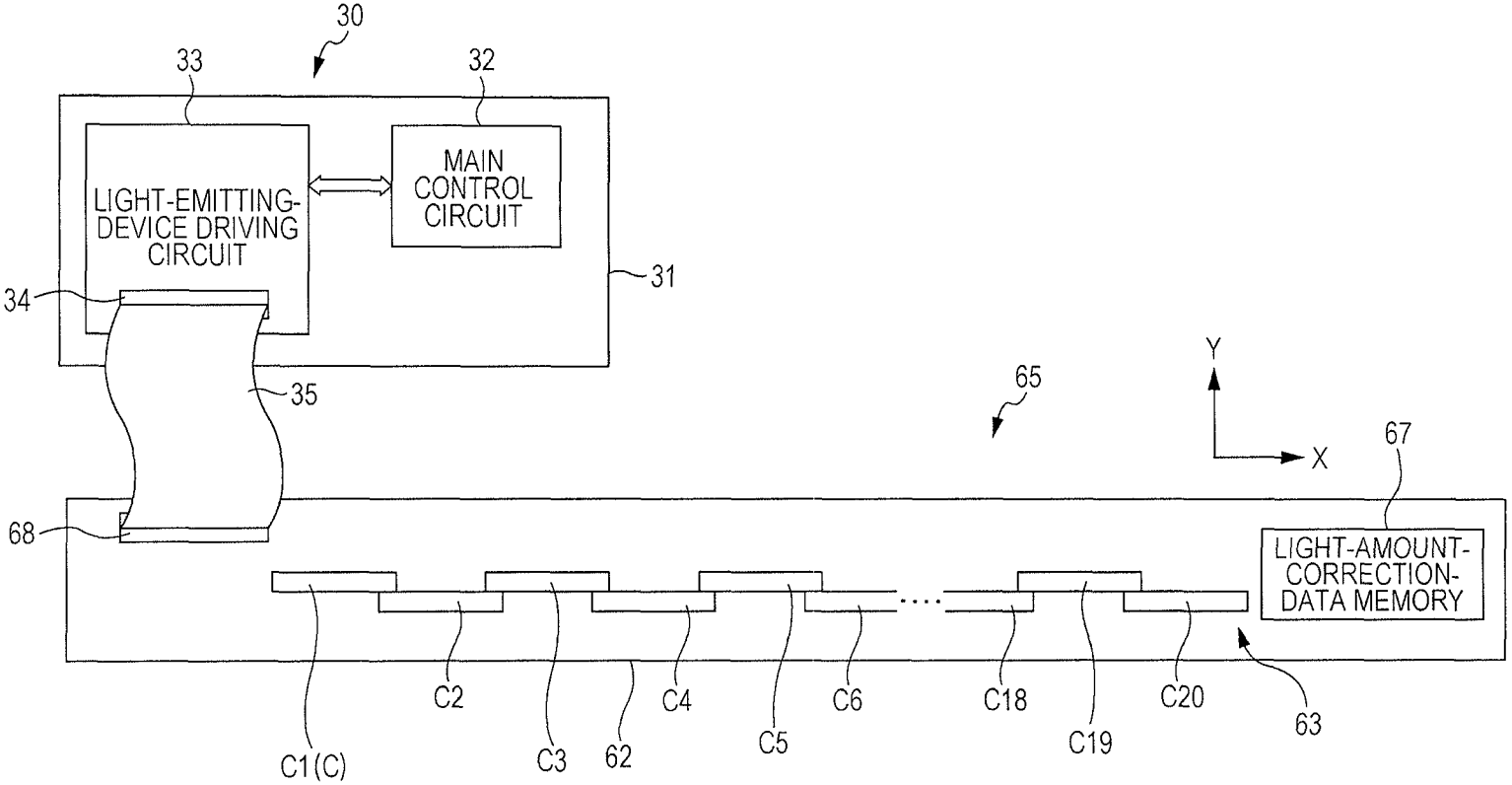
FIG. 11 is a diagram illustrating configurations of a controller and a light emitting device and the connection relationships therebetween in a case in which the present exemplary embodiment is not used.

FIG. 11 is a diagram illustrating configurations of a controller 30 and a light emitting device 65 and the connection relationships therebetween in the case in which the present exemplary embodiment is not used.

The transfer-signal supply circuit 66 (see FIG. 3A) that includes the buffer circuits Buf1*a* to Buf8*a* (see FIG. 4) in the present exemplary embodiment is not mounted on a light-emitting-chip mount board 62 in the case in which the present exemplary embodiment is not used. Instead of the transfer-signal supply circuit 66, buffer circuits Buf1*b* to Buf8*b* are provided inside a light-emitting-device driving circuit 33 (see FIG. 12 described below). Because the configurations of the other elements are the same as the configurations thereof illustrated in FIGS. 3A and 3B in the present exemplary embodiment, a description thereof is omitted.

Figure 12:
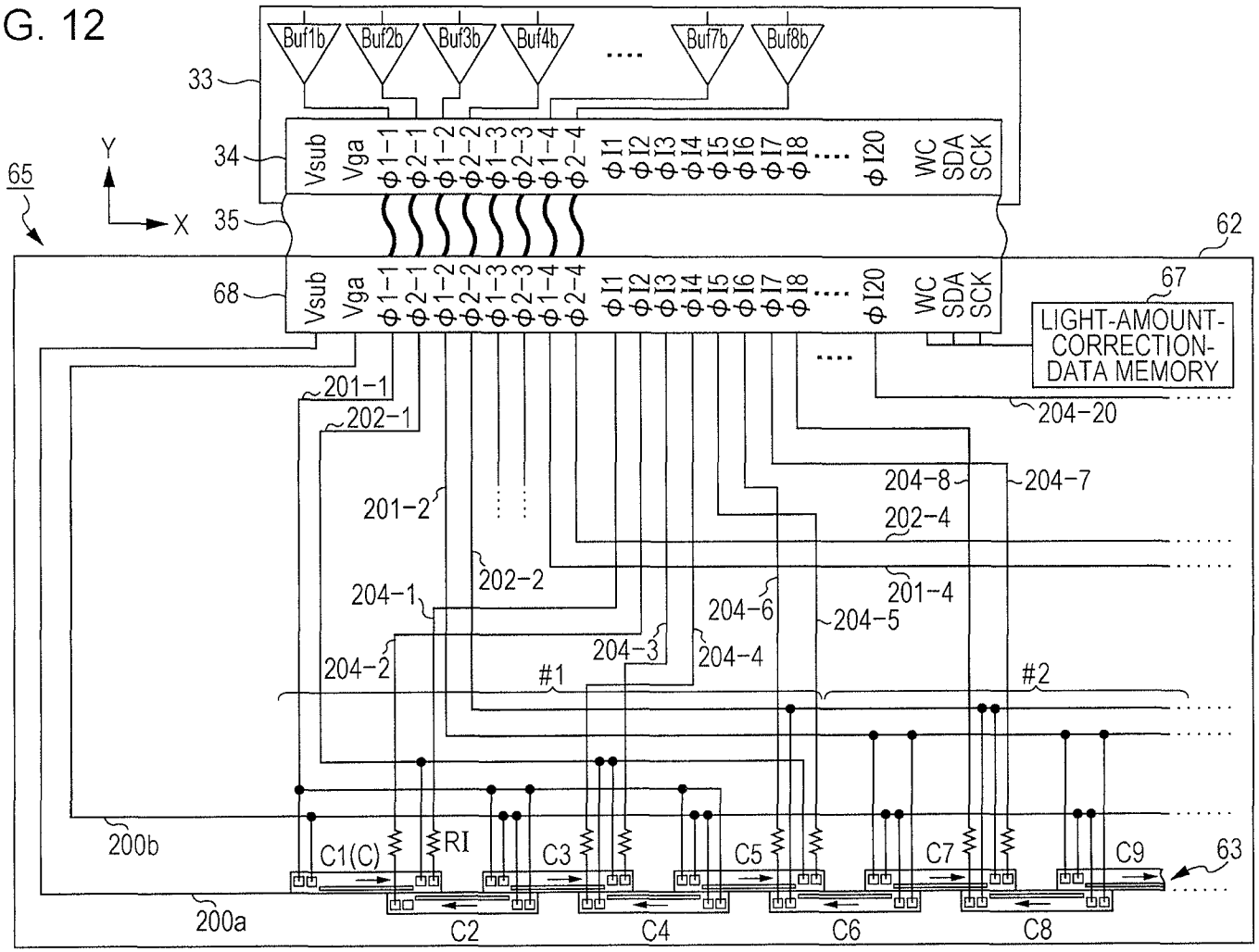
FIG. 12 is a diagram illustrating a configuration of wiring patterns (lines) on a light-emitting-chip mount board of the light emitting device in the case in which the present exemplary embodiment is not used.

FIG. 12 is a diagram illustrating a configuration of wiring patterns (lines) on the light-emitting-chip mount board 62 of the light emitting device 65 in the case in which the present exemplary embodiment is not used. Note that, in FIG. 12, one portion of the light-emitting-device driving circuit 33, and the connector 34 and the cable 35 are illustrated together with the wiring patterns.

As described above, in the case in which the present exemplary embodiment is not used, the buffer circuits Buf1*b* to Buf8*b* that transmit first transfer signals ϕ1-1, ϕ1-2, ϕ1-3, and ϕ1-4 and second transfer signals ϕ2-1, ϕ2-2, ϕ2-3, and ϕ2-4 are provided in the light-emitting-device driving circuit 33. Note that the odd-numbered buffer circuits Buf1*b*, Buf3*b*, Buf5*b* (not illustrated), and Buf7*b* transmit the first transfer signals ϕ1-1, ϕ1-2, ϕ1-3, and ϕ1-4, respectively, and the even-numbered buffer circuits Buf2*b*, Buf4*b*, Buf6*b* (not illustrated), and Buf8*b* transmit the second transfer signals ϕ2-1, ϕ2-2, ϕ2-3, and ϕ2-4, respectively.

A connector 34 includes terminals (PINs) that are used to transmit the first transfer signals ϕ1-1, ϕ1-2, ϕ1-3, and ϕ1-4 and the second transfer signals ϕ2-1, ϕ2-2, ϕ2-3, and ϕ2-4 from the light-emitting-device driving circuit 33. A connector 68 includes terminals (PINs) that are used for the light emitting device 65 to receive the first transfer signals ϕ1-1, ϕ1-2, ϕ1-3, and ϕ1-4 and the second transfer signals ϕ2-1, ϕ2-2, ϕ2-3, and ϕ2-4. The connector 34 and the connector 68 are connected to each other by a cable 35.

First-transfer-signal lines 201-1, 201-2, 201-3 (not illustrated), and 201-4 and second-transfer-signal lines 202-1, 202-2, 202-3 (not illustrated), and 202-4 are provided on the light-emitting-chip mount board 62. The first-transfer-signal lines 201-1, 201-2, 201-3, and 201-4 and the second-transfer-signal lines 202-1, 202-2, 202-3, and 202-4 are connected from the terminals (PINs) of the connector 68, which are used to receive the first transfer signals ϕ1-1, ϕ1-2, ϕ1-3, and ϕ1-4 and the second transfer signals ϕ2-1, ϕ2-2, ϕ2-3, and ϕ2-4, to ϕ1 terminals and ϕ2 terminals of light emitting chips C on a light-emitting-chip-group-by-light-emitting-chip-group basis. The configurations of the other elements are the same as the configurations thereof illustrated in FIG. 4 in the present exemplary embodiment, a description thereof is omitted.

Figures 13A, 13B:
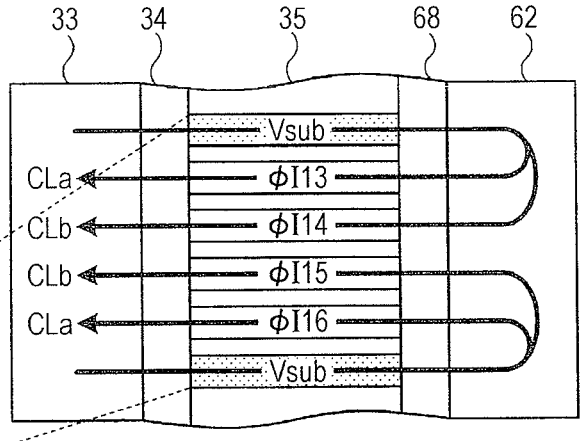
FIGS. 13A and 13B are diagrams illustrating an example of the PIN arrangement of a connector in the case in which the present exemplary embodiment is not used.

FIGS. 13A and 13B are diagrams illustrating an example of the PIN arrangement of the connector 68 in the case in which the present exemplary embodiment is not used. FIG. 13A is a diagram of the PIN arrangement of the connector 68. FIG. 13B is a diagram in which the PIN arrangement of the PINs assigned to illumination signals ϕI is illustrated so as to be enlarged. Note that, in FIG. 13B, in addition to the connector 68, the light-emitting-device driving circuit 33, the connector 34, the cable 35, and the light-emitting-chip mount board 62 are also illustrated.

Here, it is supposed that the number of terminals (PINs) of the connector 68 is forty as in the present exemplary embodiment illustrated in FIG. 5.

As illustrated in FIG. 13A, the forty terminals (PINs) are grouped into four groups. In other words, the four groups are the following: a group Ib (which is the same as the group Ia illustrated in FIG. 5A) of the PINs #1 to #3 that are used to transmit light-amount correction data items; a group IIb of the PIN #4 to #8 that are used to transmit the first transfer signals ϕ1-1 to ϕ1-4; a group IIIb of the PINs #9 to #34 that are used to transmit the illumination signals ϕI1 to ϕI20; and a group IVb of the PIN #35 to #40 that are used to transmit the second transfer signals ϕ2-1 to ϕ2-4. As described above, even in the case in which the present exemplary embodiment is not used, the necessary signals (the first transfer signals ϕ1-1 to ϕ1-4, the second transfer signals ϕ2-1 to ϕ2-4, and the illumination signals ϕI1 to ϕI20) and a reference potential Vsub and a potential Vga are assigned to the forty terminals (PINs).

However, as illustrated in FIG. 13B, regarding the group IIIb used to transmit the illumination signals ϕI1 to ϕI20, a configuration is used, in which the PINs assigned to four illumination signals ϕI (for example, the illumination signals ϕI13 to ϕI16 to which the PINs #24 to #29 are assigned) are positioned between the PINs assigned to the reference potential Vsub. Accordingly, the size of a current loop CLa of a current that flows as the illustration signal ϕI13 (the same is true for the illustration signal ϕI16) and the size of a current loop CLb of a current that flows as the illustration signal ϕI14 (the same is true for the illustration signal ϕI15) are different from each other. For this reason, the characteristic impedance of a signal line through which the illustration signal ϕI13 (the same is true for the illustration signal ϕI16) is transmitted and the characteristic impedance of a signal line through which the illustration signal ϕI14 (the same is true for the illustration signal ϕI15) is transmitted are different from each other. The signal line through which the illustration signal ϕI14 (the same is true for the illustration signal ϕI15) is transmitted is provided far from the wiring pattern through which the reference potential Vsub is supplied, compared with the signal line through which the illustration signal ϕI13 (the same is true for the illustration signal ϕI16) is transmitted. Accordingly, the inductance of the signal line through which the illustration signal ϕI14 is transmitted is increased. Thus, noise easily occurs. Furthermore, variations in the characteristic impedances of the individual illustration signals ϕI are increased. Thus, noise easily occurs.

In contrast, in the present exemplary embodiment illustrated in FIG. 5, for all the illustration signals ϕI, the inductances of the signal lines through which the illustration signals ϕI are transmitted are low, and the characteristic impedances of the individual illumination signals ϕI are the same. Thus, the difference of occurrence of noise in the signal lines through which the illustration signals ϕI are transmitted is reduced.

Furthermore, as described above, the on-state is transferred so that the transfer thyristors T sequentially enter the on-state, and the transfer thyristors T specify the light emitting thyristors L that are targets for illumination control. In this case, regarding two transfer thyristors T adjacent to each other, the on-state of the transfer thyristor T (for example, the transfer thyristor T1 illustrated in FIG. 8) that is provided at the former stage is maintained until the transfer thyristor T (the transfer thyristor T2) that is provided at the latter stage enters the on-state (a time period from the time e to the time f illustrated in FIG. 10).

It is supposed that the transfer thyristor T (the transfer thyristor T1) at the former stage is turned off before the transfer thyristor T (the transfer thyristor T2) at the latter stage enters the on-state (before the time d illustrated in FIG. 10). In this case, when the potential at the gate terminal Gt (the gate terminal Gt1) of the transfer thyristor T at the former stage becomes lower than about −0.3 V, the threshold voltage of the transfer thyristor T (the transfer thyristor T2) at the latter stage becomes lower than "L" (−3.3 V). Then, even when the potential of the transfer signal (the second transfer signal ϕ2 (ϕ2-1)) that is transmitted to the transfer thyristor T at the latter stage is changed from "H" (0 V) to "L" (−3.3 V) (the time e illustrated in FIG. 10), the transfer thyristor T (the transfer thyristor T2) at the latter stage is not able to be turned on. In other words, transfer of the on-state (self scanning) of the transfer thyristors T is interrupted.

As illustrated in FIG. 9A, when a thyristor is in the off-state, the thyristor is in a state in which no current flows (a high-resistance state). However, when the thyristor is turned on, the thyristor enters a state in which a current flows (a low-resistance state). In the case in which the present exemplary embodiment is not used, when the transfer thyristors T are in the off-state, i.e., the state in which no current flows (the high-resistance state), the buffer circuits Buf1*b* to Buf8*b* of the light-emitting-device driving circuit 33 can set the potentials of the first transfer signals ϕ1-1, ϕ1-2, ϕ1-3, and ϕ1-4 or the second transfer signals ϕ2-1, ϕ2-2, ϕ2-3, and ϕ2-4 to be "L" (−3.3 V). However, when the transfer thyristors T are turned on so as to enter the state in which a current flows (the low-resistance state), the potentials of the first transfer signals ϕ1-1, ϕ1-2, ϕ1-3, and ϕ1-4 or the second transfer signals ϕ2-1, ϕ2-2, ϕ2-3, and ϕ2-4 are shifted from "L" (−3.3 V) to a high value (the "H" (0 V) side) due to the internal resistances of the buffer circuits Buf1*b* to Buf8*b* or the resistance of the cable 35.

In this case, when the potentials of the first transfer signals ϕ1-1, ϕ1-2, ϕ1-3, and ϕ1-4 or the second transfer signals ϕ2-1, ϕ2-2, ϕ2-3, and ϕ2-4 become a value that is higher than the maintenance voltage (about −1.5 V) which is necessary to maintain the on-state of the transfer thyristors T, the transfer thyristors T are turned off as described above. Accordingly, transfer of the on-state (self scanning) of the transfer thyristors T is interrupted.

In the case in which the present exemplary embodiment is not used, in order to reduce interruption of self-scanning of the transfer thyristors T, expensive buffer circuits that have a low internal resistance and that are used for a large current are required to be used as the buffer circuits Buf1*b* to Buf8*b* of the light-emitting-device driving circuit 33. Additionally, the length of the cable 35 is required to be set to be short.

In contrast, in the present exemplary embodiment, the transfer-signal supply circuit 66 is provided on the light-emitting-chip mount board 62 of the light emitting device 65, and generates the first transfer signals ϕ1-1, ϕ1-2, ϕ1-3, and ϕ1-4 and the second transfer signals ϕ2-1, ϕ2-2, ϕ2-3, and ϕ2-4. In this configuration, distances (wiring resistances) between the output terminals of the buffer circuits Buf1*a* to Buf8*a* of the transfer-signal supply circuit 66 and the light emitting chips C are reduced. For this reason, even when the transfer thyristors T enter the on-state and then the potentials of the first transfer signals ϕ1-1, ϕ1-2, ϕ1-3, and ϕ1-4 and the second transfer signals ϕ2-1, ϕ2-2, ϕ2-3, and ϕ2-4 are shifted from "L" (−3.3 V) to a high value (the "H" (0 V) side) due to the internal resistances of the buffer circuits Buf1*b* to Buf8*b*, increases in the potentials at the cathode terminals of the transfer thyristors T so that the potentials become higher than the maintenance voltage are reduced.

In the present exemplary embodiment, the first transfer signal ϕ1 and the second transfer signal ϕ2 are transmitted from the light-emitting-device driving circuit 33, which is provided on the control board 31, to the transfer-signal supply circuit 66, which is provided on the light-emitting-chip mount board 62. In this case, it is only necessary that the first transfer signal ϕ1 and the second transfer signal ϕ2 can be transmitted (using the logic levels) so that the relationships between "H" and "L" are maintained between the buffer circuits Buf1 and Buf2, which are provided in the light-emitting-device driving circuit 33, and the buffer circuits Buf1*a* to Buf8*a*, which are provided in the transfer-signal supply circuit 66. Because the operation margins for transmitting and receiving the signals using the logic levels are wide, an influence caused by deterioration of the signals due to the internal resistances is small. Even when the length of the cable 35 is set to be long, the signals are not easily influenced.

Furthermore, because the transfer-signal supply circuit 66 is provided on the light-emitting-chip mount board 62, the first transfer signal ϕ1 and the second transfer signal ϕ2 and the light emitting chips C are tested as one piece. Accordingly, the light emitting device 65 can be provided, in which interruption of transfer of the on-state (self-scanning) of the transfer thyristors T of the light emitting chips C is reduced.

In contrast, in the case in which the present exemplary embodiment is not used (see FIG. 11), the buffer circuits Buf1*b* to Buf8*b* are mounted in the light-emitting-device driving circuit 33. Accordingly, the light emitting device 65 is tested separately from the buffer circuits Buf1*b* to Buf8*b*. In a case of assembly of the image forming apparatus 1, the light emitting device 65 and the light-emitting-device driving circuit 33, in which the buffer circuits Buf1*b* to Buf8*b* are mounted, are combined together.

In this case, when the transfer thyristors T are turned on, the potentials of the first transfer signals ϕ1-1, ϕ1-2, ϕ1-3, and ϕ1-4 and the second transfer signals ϕ2-1, ϕ2-2, ϕ2-3, and ϕ2-4 may not be able to be maintained at "L" (−3.3 V) due to the internal resistances of the buffer circuits Buf1*b* to Buf8*b*, the resistance of the cable 35, or the like. Consequently, when the potentials of the first transfer signals ϕ1-1, ϕ1-2, ϕ1-3, and ϕ1-4 or the second transfer signals ϕ2-1, ϕ2-2, ϕ2-3, and ϕ2-4 are shifted to a high value (the "H" (0 V) side) so as to be higher than the maintenance voltage of the transfer thyristors T, the transfer thyristors T in the on-state are turned off, so that transfer of the on-state is interrupted.

In other words, in the case in which the present exemplary embodiment is not used, even though the light emitting device 65 has been determined as a non-defective item by being tested, when assembly of the image forming apparatus 1 is performed and the light emitting device 65 and the light-emitting-device driving circuit 33 are tested in combination, the light emitting device 65 and the light-emitting-device driving circuit 33 may not operate correctly.

Note that the illumination signals ϕI are supplied from the light-emitting-device driving circuit 33 to the light emitting chips C of the light emitting device 65 on a light-emitting-chip-C-by-light-emitting-chip-C basis by buffer circuits that are similar to the buffer circuits Buf1 and Buf2. However, currents may be supplied on a light-emitting-chip-C-by-light-emitting-chip-C basis to the light emitting thyristors L that are specified by the transfer thyristors T which are in the on-state. Thus, a problem such as the above-described interruption of transfer of the on-state of the transfer thyristors T does not easily occur. For this reason, the buffer circuits that supply the illumination signals ϕI may not be mounted on the light-emitting-chip mount board 62 of the light emitting device 65.

As described above, in the present exemplary embodiment, because the light emitting device 65 includes the transfer-signal supply circuit 66, the first transfer signals ϕ1-1, ϕ1-2, ϕ1-3, and ϕ1-4, the second transfer signals ϕ2-1, ϕ2-2, ϕ2-3, and ϕ2-4, and the light emitting chips C are tested in combination. Thus, in a case of assembly of the image forming apparatus 1, it is only necessary that the first transfer signal ϕ1 and the second transfer signal ϕ2 can be transmitted (using the logic levels) so that the relationships between "H" and "L" are maintained between the light-emitting-device driving circuit 33, which is provided on the control board 31, and the transfer-signal supply circuit 66, which is provided on the light-emitting-chip mount board 62. The operation margin for transmitting the signals using the logic levels is wide. Thus, in the present exemplary embodiment, even when the internal resistances of the buffer circuits Buf1 and Buf2 of the light-emitting-device driving circuit 33 and/or the resistance of the cable 35 is high, occurrence of abnormality in the case of transmitting the signals using the logic levels is reduced.

As described above, in the present exemplary embodiment, inexpensive buffer circuits having a high internal resistance can be used as the buffer circuits Buf1 and Buf2 of the light-emitting-device driving circuit 33 and the buffer circuits Buf1*a* to Buf8*a* of the transfer-signal supply circuit 66.

Furthermore, in the present exemplary embodiment, the memory area of the light-amount-correction-data memory 67 is divided into multiple areas, and the light-amount correction data items for different conditions for use (the condition 1 for use and the condition 2 for use) are stored in the areas (the areas A and B) that differ on a condition-for-use-by-condition-for-use basis. Accordingly, it is not necessary that each of multiple light emitting devices 65 include a corresponding one of light-amount-correction-data memories 67, and that light-amount correction data items which differ on a condition-for-use-by-condition-for-use basis be stored in the corresponding light-amount-correction-data memories 67. In other words, the light emitting device 65 may have the same configuration even when the light emitting device 65 is used even under either the condition 1 for use or the condition 2 for use. The controller 30 may change the start address of the light-amount-correction-data memory 67 in accordance with a condition for use, and may read the light-amount correction data items.

Additionally, in the present exemplary embodiment, two signals, i.e., the first transfer signal ϕ1 and the second transfer signal ϕ2, are transmitted as transfer signals between the light-emitting-device driving circuit 33 and the light emitting device 65 (see FIG. 5A). In contrast, in the case in which the present exemplary embodiment is not used, eight signals, i.e., the first transfer signals ϕ1-1, ϕ1-2, ϕ1-3, and ϕ1-4 and the second transfer signals ϕ2-1, ϕ2-2, ϕ2-3, and ϕ2-4, are transmitted as transfer signals (see FIG. 13A). Thus, in the present exemplary embodiment, the number of transfer signals is reduced by six, compared with that in the case in which the present exemplary embodiment is not used. As illustrated in FIGS. 5A and 5B, the reference potential Vsub is provided so that the PINs assigned to the reference potential Vsub are positioned adjacent to the PINs assigned to all of the illumination signals ϕI without changing the number of PINs (forty). Accordingly, the characteristic impedances of the signal lines through which all of the illumination signals ϕI are transmitted are set to be the same low value, thereby reducing noise that occurs when the levels of the illumination signals ϕI are changed (from "H" to "L" or from "L" to "H").

Moreover, in the present exemplary embodiment illustrated in FIG. 5A, the number of terminals (PINs) assigned to the potential Vga is four, and the number of terminals (PINs) assigned to the reference potential Vsub is eleven. The number of terminals (PINs) assigned to the potential Vga and the number of terminals (PINs) assigned to the reference potential Vsub are increased by a large amount, compared with the number of terminals (PINs) assigned to the potential Vga is three and the number of terminals (PINs) assigned to the reference potential Vsub is six in the case in which the present exemplary embodiment is not used and which is illustrated in FIG. 13A. Accordingly, the potentials in the light emitting device 65 are more stable.

As described above, the light emitting device 65 according to the present exemplary embodiment may have the same configuration regardless of conditions for use, so that reception of the signals can be performed with more stability.

FIGS. 14A to 14E are diagrams illustrating configurations of high-cutoff filters that are provided in the output terminals of the buffer circuits Buf1*a* to Buf8*a* of the transfer-signal supply circuit 66.

In order to reduce variations in the potential levels of the signals (the first transfer signals ϕ1-1, ϕ1-2, ϕ1-3, and ϕ1-4 and the second transfer signals ϕ2-1, ϕ2-2, ϕ2-3, and ϕ2-4) that are transmitted from the output terminals of the individual buffer circuits Buf1*a* to Buf8*a*, high-cutoff filters (low-pass filters) that cut off high frequency components may be provided in the output terminals of the individual buffer circuits Buf1*a* to Buf8*a*. Note that, in FIGS. 14A to 14E, the buffer circuits Buf1*a* to Buf8*a* are denoted by Buf, the first transfer signals ϕ1-1, ϕ1-2, ϕ1-3, and ϕ1-4 are denoted by ϕ1-*x*, and the second transfer signals ϕ2-1, ϕ2-2, ϕ2-3, and ϕ2-4 are denoted by ϕ2-*x*.

Figure 14A:
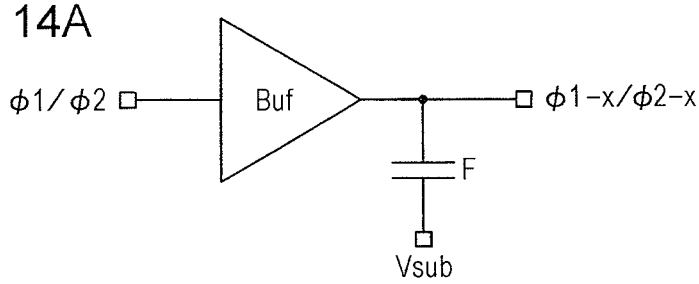
FIGS. 14A to 14E are diagrams illustrating configurations of high-cutoff filters that are provided in output terminals of buffer circuits of a transfer-signal supply circuit in the present exemplary embodiment.
Figure 14B:
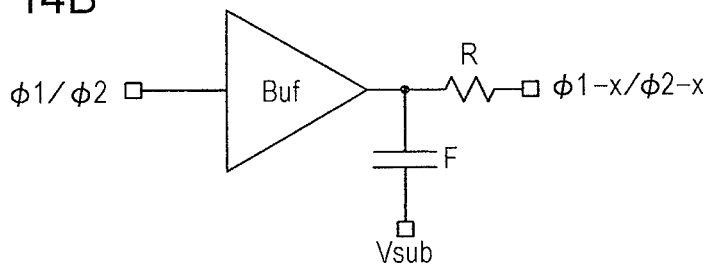
Figure 14C:
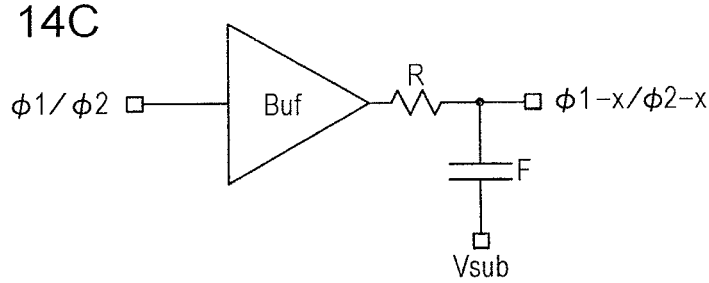
Figure 14D:
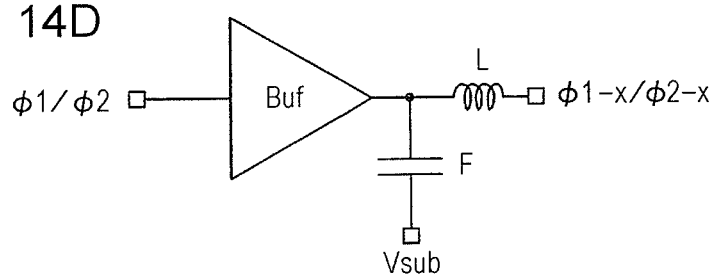
Figure 14E:
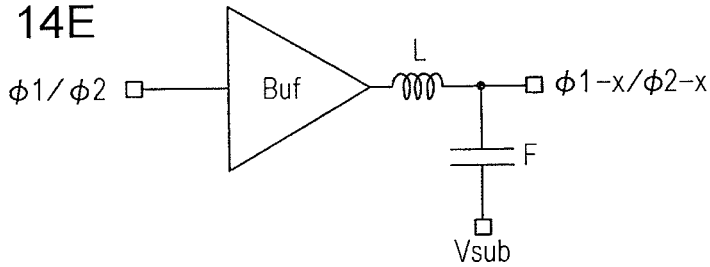

A configuration which is illustrated in FIG. 14A and in which a capacitor (F) is provided in an output terminal, configurations which are illustrated in FIGS. 14B and 14C and in which a capacitor (F) and a resistor (R) are provided in combination in an output terminal, and configurations which are illustrated in FIGS. 14D and 14E and in which a capacitor (F) and an inductance (L) are provided in combination in an output terminal may be used for the high-cutoff filters.

With the configurations which are illustrated in FIGS. 14D and 14E and in which a capacitor (F) and an inductance (L) are provided in combination, a reduction in the level (amplitude) of a signal that is output from the output terminal due to a resistor (R) is reduced.

Second Exemplary Embodiment

In the first exemplary embodiment, one transfer-signal supply circuit 66 is provided on the light-emitting-chip mount board 62 (see FIGS. 3A and 3B). Because the current limit of a power-supply pin or a GND pin of an IC exists, when a current flowing through a buffer circuit is large, it is necessary to select an IC in which the number of buffer circuits is small. In the second exemplary embodiment, four transfer-signal supply circuits 66-1 to 66-4 are provided. Hereinafter, the difference between the second exemplary embodiment and the first exemplary embodiment will be described, and a description of portions common to the second exemplary embodiment and the first exemplary embodiment will be omitted.

Figure 15:
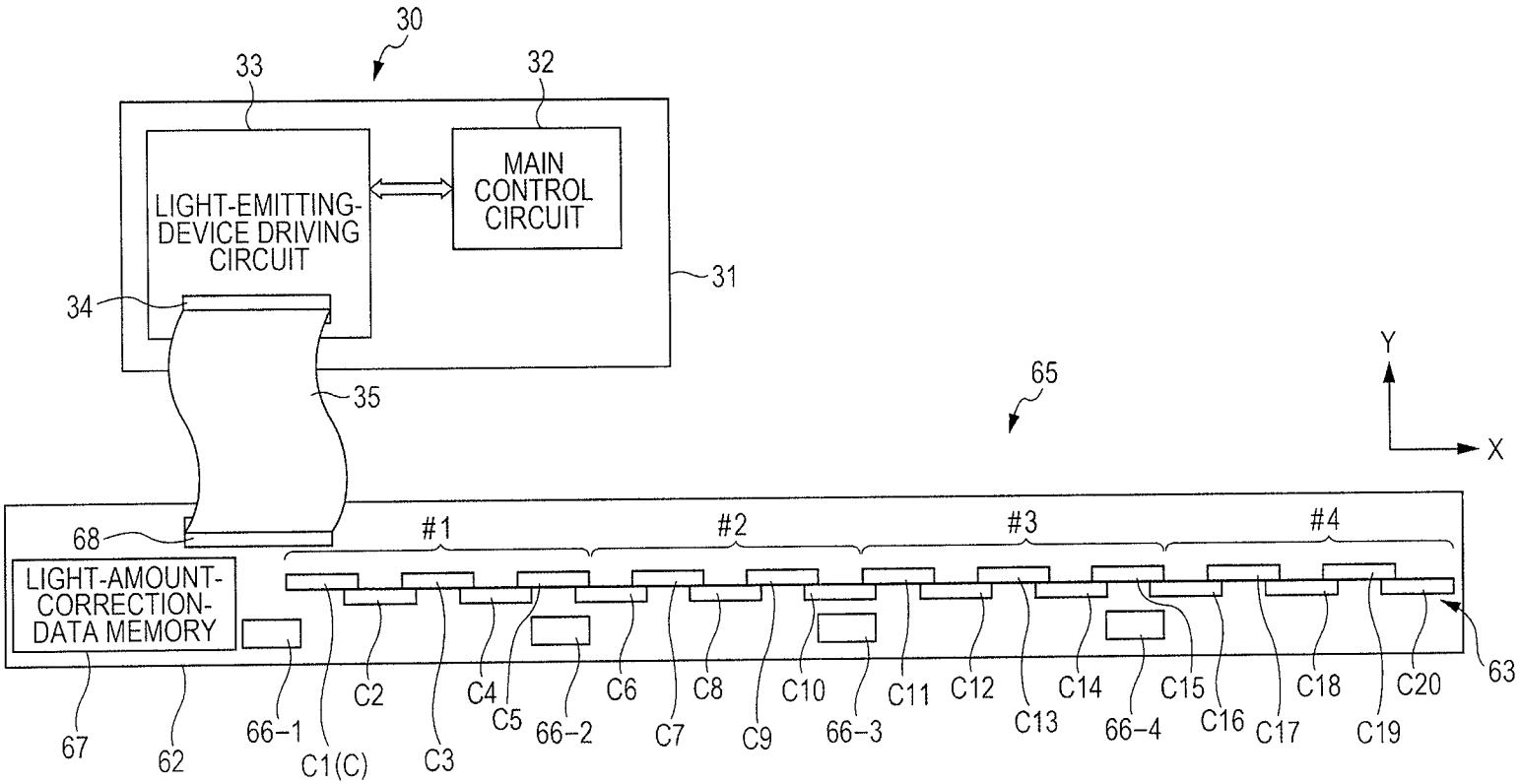
FIG. 15 is a diagram illustrating configurations of a controller and a light emitting device and the connection relationships therebetween in a second exemplary embodiment.

FIG. 15 is a diagram that illustrates configurations of a controller 30 and a light emitting device 65 in the second exemplary embodiment, and that illustrates the connection relationships therebetween.

Referring to FIG. 15, the four transfer-signal supply circuits 66-1 to 66-4 are disposed in the vicinity of light-emitting-chip groups to which transfer signals are supplied from the four transfer-signal supply circuits 66-1 to 66-4. In other words, the transfer-signal supply circuit 66-1 includes buffer circuits Buf1*a* and Buf2*a* (not illustrated), is disposed in the vicinity of a light-emitting-chip group #1 that is constituted by light emitting chips C1 to C5, and transmits a first transfer signal ϕ1-1 and a second transfer signal ϕ2-1. The transfer-signal supply circuit 66-2 includes buffer circuits Buf3*a* and Buf4*a* (not illustrated), is disposed in the vicinity of a light-emitting-chip group #2 that is constituted by light emitting chips C6 to C10, and transmits a first transfer signal ϕ1-2 and a second transfer signal ϕ2-2. The transfer-signal supply circuit 66-3 includes buffer circuits Buf5*a* and Buf6*a* (not illustrated), is disposed in the vicinity of a light-emitting-chip group #3 that is constituted by light emitting chips C11 to C15, and transmits a first transfer signal ϕ1-3 and a second transfer signal ϕ2-3. The transfer-signal supply circuit 66-4 includes buffer circuits Buf7*a* and Buf8*a* (not illustrated), is disposed in the vicinity of a light-emitting-chip group #4 that is constituted by light emitting chips C16 to C20, and transmits a first transfer signal ϕ1-4 and a second transfer signal ϕ2-4.

In the second exemplary embodiment, because the transfer-signal supply circuits 66-1 to 66-4 are disposed in the vicinity of the light-emitting-chip groups that receive the signals which are transmitted by the individual transfer-signal supply circuits 66-1 to 66-4, the lengths of first-transfer-signal lines 201-1, 201-2, 201-3, and 201-4 and second-transfer-signal lines 202-1, 202-2, 202-3, and 202-4 (see FIG. 4) are reduced. Accordingly, variations in the potentials of the first-transfer-signal lines 201-1, 201-2, 201-3, and 201-4 and the second-transfer-signal lines 202-1, 202-2, 202-3, and 202-4 due to the resistances thereof are reduced.

In the first and second exemplary embodiments, although an IC that is a standardized product may be used as the buffer circuits Buf1*a* to Buf8*a*, the buffer circuits Buf1*a* to Buf8*a* may be formed as an application-specific integrated circuit (ASIC). If the buffer circuits Buf1*a* to Buf8*a* are formed as an ASIC, it is possible to increase the current capacity of an output terminal, or to enhance an internal wiring pattern (more particularly, a GND wiring pattern) so that the internal resistance is reduced.

In the first and second exemplary embodiments, each of a value of "H" (0 V) that is a high-level potential and a value of "L" (−3.3 V) that is a low-level potential is an example, and another value may be set with consideration of the operation of the light emitting device 65.

In the first and second exemplary embodiments, the transfer thyristors T are driven using two phases formed of the first transfer signal ϕ1 and the second transfer signal ϕ2. However, transfer signals having three phases may be transmitted, and every three transfer thyristors T may be driven using the transfer signals.

Furthermore, in the first and second exemplary embodiments, one SLED is mounted in each of the light emitting chips C. However, the number of SLEDs may be two or more. When two or more SLEDs are mounted, each of the SLEDs may be replaced with a light emitting chip C.

Additionally, in the first and second exemplary embodiments, in the description given above, anode common in which the anode terminals of the thyristors (the transfer thyristors T and the light emitting thyristors L) are connected to the board 80 so as to serve as a common anode is used. Cathode common in which the cathode terminals are connected to the board 80 so as to serve as a common cathode may be used by changing the polarities of the circuits.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light emitting device comprising:

a plurality of light emitting chips;

each of the plurality of light emitting chips including a plurality of light emitting elements, and a plurality of transfer elements that sequentially specify, by sequentially entering an on-state, the plurality of light emitting elements as targets for control of illumination or non-illumination, each of the plurality of transfer elements being provided for a corresponding one of the plurality of light emitting elements, a mount board on which the plurality of light emitting chips are mounted; and a buffer amplifier that is provided on the mount board, and that outputs a transfer signal on the basis of an input transfer signal, the transfer signal being used to sequentially set the plurality of transfer elements, which are included in each of the plurality of light emitting chips, to be in the on-state, wherein the light emitting device further includes a storage member in which a plurality of groups of control data including correction values are stored, wherein the correction values are set so as to correspond to at least each of a plurality of driving units that drive the light emitting device, and are used to correct amounts of light for the plurality of light emitting elements in each of the plurality of light emitting chips, wherein the correction values are set and stored in the storage member in accordance with printing conditions, wherein the printing conditions include a first condition for monochrome printing and a second condition for color printing, wherein when a printing condition in the light emitting device is the monochrome printing, the correction values are stored in a first storage area of the storage member, and when the printing condition in the light emitting device is the color printing, the correction values are stored in a second storage area of the storage member, the second storage area is different from the first storage area, and wherein a number of bits of the correction values stored in the first storage area is less than a number of bits of the correction values stored in the second storage area.

2. The light emitting device according to claim 1, wherein the plurality of light emitting chips are grouped into a plurality of light-emitting-chip groups, each of the plurality of light-emitting-chip groups including at least one of the plurality of light emitting chips, and the buffer amplifier that outputs the transfer signal is provided for each of the plurality of light-emitting-chip groups.

3. The light emitting device according to claim 2, wherein the light emitting device is connected to a multicore cable which is formed so that wiring patterns through which illumination signals are transmitted to the plurality of light emitting chips are adjacent to wiring patterns that are used to supply currents flowing in a direction opposite to a direction in which currents flow through the wiring patterns through which the illumination signals are transmitted, each of the illumination signals being transmitted through a corresponding one of the wiring patterns to a corresponding one of the light emitting chips in order to cause the plurality of light emitting elements in the light emitting chip to perform illumination.

4. The light emitting device according to claim 3, wherein the cable is a flexible flat cable.

5. The light emitting device according to claim 1, wherein the light emitting device is connected to a multicore cable which is formed so that wiring patterns through which illumination signals are transmitted to the plurality of light emitting chips are adjacent to wiring patterns that are used to supply currents flowing in a direction opposite to a direction in which currents flow through the wiring patterns through which the illumination signals are transmitted, each of the illumination signals being transmitted through a corresponding one of the wiring patterns to a corresponding one of the light emitting chips in order to cause the plurality of light emitting elements in the light emitting chip to perform illumination.

6. The light emitting device according to claim 5, wherein the cable is a flexible flat cable.

7. The light emitting device according to claim 1, wherein the buffer amplifier is formed of complementary metal-oxide semiconductor (CMOS).

8. The light emitting device according to claim 1, wherein the buffer amplifier limits supply currents output to the plurality of transfer elements based on a predetermined value.

9. The light emitting device according to claim 8, wherein the predetermined value is 30 mA.

10. The light emitting device according to claim 1, wherein the buffer amplifier adjusts potentials of the input transfer signal such that potentials of the output transfer signals indicate either a logic low level or a logic high level.

11. A print head comprising:

a light emitting unit that includes a plurality of light emitting chips, each of the plurality of light emitting chips including a plurality of light emitting elements, and a plurality of transfer elements that sequentially specify, by sequentially entering an on-state, the plurality of light emitting elements as targets for control of illumination or non-illumination, each of the plurality of transfer elements being provided for a corresponding one of the plurality of light emitting elements, a mount board on which the plurality of light emitting chips are mounted, and a buffer amplifier that is provided on the mount board, and that outputs a transfer signal on the basis of an input transfer signal, the transfer signal being used to sequentially set the plurality of transfer elements, which are included in each of the plurality of light emitting chips, to be in the on-state; and an optical unit that forms an image using light which is emitted from the light emitting unit, wherein the printing head further includes a storage member in which a plurality of groups of control data including correction values are stored, wherein the correction values are set so as to correspond to at least each of a plurality of driving units that drive the light emitting device, and are used to correct amounts of light for the plurality of light emitting elements in each of the plurality of light emitting chips, wherein the correction values are set and stored in the storage member in accordance with printing conditions, wherein the printing conditions include a first condition for monochrome printing and a second condition for color printing, wherein when a printing condition in the light emitting device is the monochrome printing, the correction values are stored in a first storage area of the storage member, and when the printing condition in the light emitting device is the color printing, the correction values are stored in a second storage area of the storage member, the second storage area is different from the first storage area, and wherein a number of bits of the correction values stored in the first storage area is less than a number of bits of the correction values stored in the second storage area.

12. An image forming apparatus comprising:

an image carrier;

a charging unit that charges the image carrier;

a light emitting unit that includes a plurality of light emitting chips, each of the plurality of light emitting chips including a plurality of light emitting elements, and a plurality of transfer elements that sequentially specify, by sequentially entering an on-state, the plurality of light emitting elements as targets for control of illumination or non-illumination, each of the plurality of transfer elements being provided for a corresponding one of the plurality of light emitting elements, a mount board on which the plurality of light emitting chips are mounted, and a buffer amplifier that is provided on the mount board, and that outputs a transfer signal on the basis of an input transfer signal, the transfer signal being used to sequentially set the plurality of transfer elements, which are included in each of the plurality of light emitting chips, to be in the on-state;

a driving unit that transmits the transfer signal to the buffer amplifier of the light emitting unit, and that transmits each of illumination signals to a corresponding one of the plurality of light emitting chips, the illumination signal being used to control illumination or non-illumination of the plurality of light emitting elements that are specified by the plurality of transfer elements which are included in the light emitting chip and which are in the on-state;

an optical unit that forms an image using light which is emitted from the light emitting unit;

a developing unit that develops an electrostatic latent image which is formed on the image carrier by exposing the image carrier to light with the light emitting unit; and a transferring unit that transfers the electrostatic latent image, which has been developed on the image carrier, onto a transfer-receiving body, wherein the driving unit includes a plurality of driving units, and the light emitting unit further includes a storage member in which a plurality of groups of control data including correction values are stored, wherein the correction values are set so as to correspond to at least each of the plurality of driving units which drive the light emitting unit and are used to correct amounts of light for the plurality of light emitting elements in each of the plurality of light emitting chips, wherein each of the plurality of driving units reads the correction values that are set so as to correspond to the driving unit from the plurality of groups of control data which are stored in the storage member, and transmits the illumination signals on the basis of the correction values, wherein the correction values are set and stored in the storage member in accordance with printing conditions, wherein the printing conditions include a first condition for monochrome printing and a second condition for color printing, wherein when a printing condition in the light emitting device is the monochrome printing, the correction values are stored in a first storage area of the storage member, and when the printing condition in the light emitting device is the color printing, the correction values are stored in a second storage area of the storage member, the second storage area is different from the first storage area, and wherein a number of bits of the correction values stored in the first storage area is less than a number of bits of the correction values stored in the second storage area.

13. The image forming apparatus according to claim 12, wherein the light emitting unit and the driving unit are connected to a multicore cable which is formed so that wiring patterns through which the illumination signals are transmitted to the plurality of light emitting chips are adjacent to wiring patterns that are used to supply currents flowing in a direction opposite to a direction in which currents flow through the wiring patterns through which the illumination signals are transmitted, each of the illumination signals being transmitted through a corresponding one of the wiring patterns to a corresponding one of the light emitting chips.

* * * * *